US005390469A

United States Patent [19]

Shimizu et al.

[11] Patent Number: 5,390,469

[45] Date of Patent: Feb. 21, 1995

[54] FILLING/SEALING APPARATUS FOR AMPULE OR THE LIKE AND METHOD FOR MONITORING THIS APPARATUS

[75] Inventors: Koji Shimizu, Honjo; Toshiyasu Ehara; Kazumi Maruoka, both of Saitama; Kiyoshi Yamagishi, Kumagaya, all of Japan

[73] Assignee: Eisai Co. Ltd., Tokyo, Japan

[21] Appl. No.: 89,443

[22] Filed: Jul. 12, 1993

[30] Foreign Application Priority Data

Jul. 14, 1992 [JP] Japan ..... 4-209636
Jul. 21, 1992 [JP] Japan ..... 4-215618

[51] Int. Cl.[6] ..... B65B 57/02; B65B 7/16

[52] U.S. Cl. ..... 53/53; 53/280; 53/284.6; 53/505

[58] Field of Search ..... 53/284.6, 272, 280, 53/279, 54, 53, 504, 506, 505

[56] References Cited

U.S. PATENT DOCUMENTS 3,012,386 12/1961 Pechmann et al. ..... 53/284.6 X
3,652,249 3/1972 White ..... 53/284.6 X
3,837,378 9/1974 Kanki et al. ..... 53/284.6 X
3,939,626 2/1976 Cioni et al. ..... 53/284.6 X
3,986,320 10/1976 Bausch et al. ..... 53/284.6 X
4,096,683 6/1978 McMickle, Jr. ..... 53/284.6 X
4,722,169 2/1988 DeSantis ..... 53/504 X

*Primary Examiner*—James F. Coan
*Attorney, Agent, or Firm*—Griffin, Butler Whisenhunt & Kurtossy

[57] ABSTRACT

A filling/sealing apparatus used for ampules generally has a feed star wheel feeding ampules, a turntable transporting the ampules delivered from the feed star wheel, and an intermediate star wheel interposed between the feed star wheel and the turntable. Around the turntable, filling needles fill the ampules with liquid, burners seal the upper ends of the ampules, and pincers pinch the upper ends of ampules. Sensors determine whether the ampules being transported by the intermediate star wheel have the upper ends intact and damaged ampules are removed. The number of ampules that can be held by the turntable as well as the star wheel is set to integral times as many as the number of ampules that can be simultaneously filled by the filling needles.

10 Claims, 28 Drawing Sheets

FILLING/SEALING APPARATUS FOR AMPULE OR THE LIKE AND METHOD FOR MONITORING THIS APPARATUS

BACKGROUND OF THE INVENTION

The present invention relates to an apparatus used to fill ampule or the like with a given type of liquid through its upper open end and then to seal said upper open end, and to a method for monitoring this apparatus.

The apparatus adapted for automatically performing sequential processes of washing and drying an empty ampule or the like having an upper open end, then filling this with a given type of liquid and sealing the upper open end is well known, for example, from Japanese patent application Disclosure Gazettes Nos. 1972-8692 and 1975-125881. Japanese patent application Disclosure Gazette No. 1975-83187 also discloses "Ampoule Filling/Sealing Machine".

For such apparatus adapted for automatically performing the sequential processes of filling the ampules or the like with a given type of liquid and sealing the upper ends thereof, the ampules or the like should be maintained in a stabilized orientation or posture during transport thereof in order to assure that the processes such as insertion of filling needles into the open ends of the ampules or the like and heat sealing the open ends by burner means may be smoothly performed.

SUMMARY OF THE INVENTION

Accordingly, it is an object of the invention to provide an apparatus adapted to transporting the ampules or the like by rotation of a turntable with the upper ends of the ampules or the like pinched with pincers means, thus allowing sequential processes of filling and heat sealing to be smoothly performed with a high precision while the ampules or the like are maintained in a stabilized posture during transport thereof.

This object is achieved, according to the invention, by a filling/sealing apparatus for ampules or the like generally having a feed star wheel serving to feed ampules or the like and a turntable serving to transport the ampules or the like having been fed from the feed star wheel to a subsequent process, wherein there are provided around the turntable filling needles serving to fill the ampules or the like with a given type of liquid and burners serving to seal upper ends of the ampules or the like and wherein the turntable is provided with pincers serving to pinch the upper ends of the ampules or the like.

According to the invention, the ampules can be fed and transported in a stabilized posture by an appropriate combination of features as will be described.

The feed star wheel may be provided with shutters serving to prevent the ampules or the like from being received by recesses formed in a peripheral surface of the feed star wheel to assure that the ampules or the like already fed are reliably filled with a given type of liquid and then sealed. The apparatus as a whole is never stopped in the course of process even the shutters are actuated and therefore production of damaged ampules is avoided.

There may be provided sensors serving to determine whether the ampules or the like being transported by an intermediate star wheel interposed between the feed star wheel and the turntable have their heads, e.g. upper ends, damaged or not and means serving to put the ampules or the like having been determined by the sensors to have no head out of the way during transport thereof to assure that only the normal ampules or the like are fed to the turntable and thereby to avoid damages of the fill in needles tips, breakage of the ampules or the like occurring within the turntable and scattering of liquid.

Each of the filling needles may be provided on its forward end with a spout adapted for laterally jetting a stream of the liquid to assure that the liquid obliquely strikes against and flows along the inner side wall of each ampule or the like and thereby operation of filling free from problems such as dripping and foaming is achieved.

A liquid feed pump serving to pump the liquid into the respective filling needles may be provided with a suck-back mechanism adapted to direct the liquid stream back into the respective filling needles immediately after operation of filling to assure that neither liquid drip from the tip of each filling needle nor burning of ampule head occurs, the upper ends of the ampules or the like are sealed with a uniform shape and a quantity of the liquid with which each ampule or the like is to be filled is controlled with a high precision.

Each of the burners may be provided with means serving to continue to heat a sealed portion of each ampule or the like for a short period of time after the ampules has been sealed by the burner to round the upper end of each filled and sealed ampule or the like with an uniform wall thickness.

It is another object of the invention to provide a method for easily monitoring the result of sequential processes in the above-mentioned automatic filling-/sealing apparatus for ampules or the like.

This object is achieved according to the invention, by a method comprising steps of setting the number of ampules or the like that can be held by the turntable as well as the star wheels to integral times as many as the ampules or the like that can be simultaneously filled by the filling needles with a given type of liquid and dividing the ampules or the like into groups corresponding to the number of the ampules or the like that can be simultaneously filled by said filling needles with the liquid so that the result of filling operation can be monitored for every group. In this way, the ampules can be sampled according to individual ampule group number and a quantity of oxygen contained In a space above the liquid in each ampule as well as a quantity of the liquid having been introduced into this ampule can be comparatively checked for every filling needle. In addition, in view of a fact that a liquid drip from the filling needle might adversely affect the sealing effect on the upper end of each ampule, the sealed upper ends of the ampules may be compared one to another within each group to check said liquid drip from the filling needle.

BRIEF DESCRIPTION OF THE DRAWINGS

The above and other objects of the invention will be seen by reference to the description taken in connection with the accompanying drawings, in which.

DETAILED DESCRIPTION OF THE INVENTION

The ampule filling/sealing apparatus of the present invention will be described by way of example.

Figure 1:
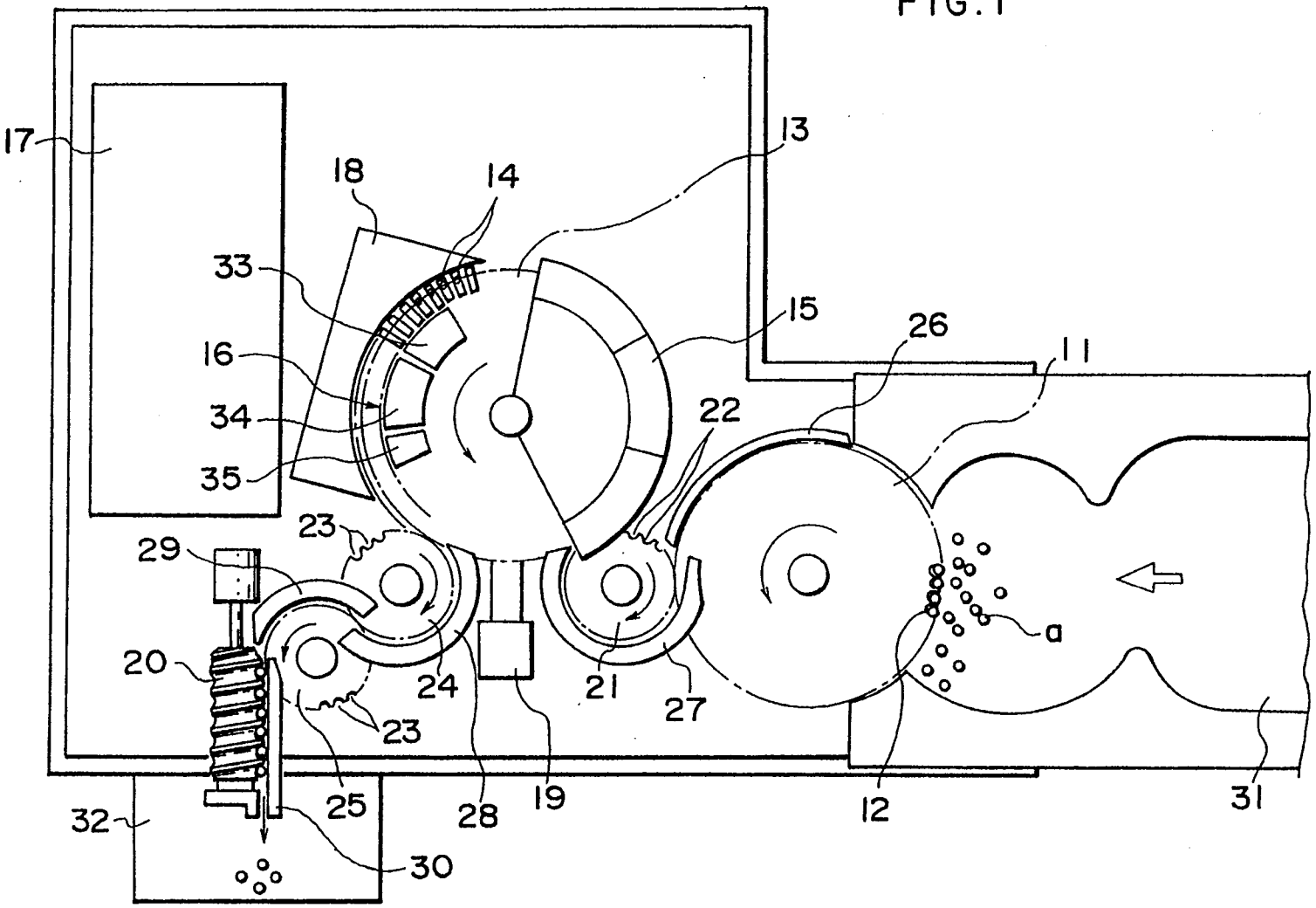
FIG. 1 is a plan view showing an embodiment of ampule filling/sealing apparatus constructed in accordance with the invention.

FIG. 1 is a plan view of the ampule filling/sealing apparatus constructed In accordance with the invention. Referring to FIG. 1, a feed star wheel 11 is adapted to be counterclockwise rotated and is formed along its peripheral surface with recesses 12 adapted to receive ampules a.

A turntable 13 is adapted to be counterclockwise rotated and provided along its periphery at regular intervals with pincers 14 to pinch upper ends of intervals with pincers 14 to pinch upper ends of respective ampules a. Around the turntable 3 there are provided a filling unit 15 to fill the ampules a with a given type of liquid and a burner 16 to heat seal the upper ends of the respective ampules. The burner 16 comprises burner sections 33, 34 and 35. Reference numeral 17 designates a liquid feed pump for the filling unit 15 and reference numeral 18 designates an exhaust duct allowing heat to escape from burner 16.

Reference numeral 19 designates a discharging chute through which upper portions of the ampules a burned off by the burner 16 are discharged and reference numeral 20 designates a screw conveyor to convey the ampules a away from the filling/sealing apparatus.

There is provided between the feed star wheel 11 and the turntable 13 an intermediate star wheel 21 adapted to be clockwise rotated. The intermediate star wheel 21 is formed along its peripheral surface with recesses 22 adapted to receive the ampules a. There are provided between the turntable 13 and the screw conveyor 20 additional intermediate star wheel 24, 25, each being also formed along its peripheral surface with recesses 23. The intermediate star wheel 24 is adapted to be clockwise rotated and the intermediate star wheel 25 is adapted to be counterclockwise rotated.

There are provided around the feed star wheel 11, the intermediate star wheels 21, 24, 25 and the screw conveyor 20, respectively, guides 26 through 30 to assist a smooth conveyance of the ampules a.

In the filling/sealing apparatus as has been described above, the ampules a transported in the direction indicated by a blank arrow on the conveyor 31 with their upper ends being still opened are successively received by the recesses 12 of the feed star wheel 11 which is being rotated to transport them along the guide 26 and successively delivers then to the turntable 13 via the intermediate star wheel 21.

The ampules a are then counterclockwise transported with their upper ends being pinched by the pincers 14 mounted on the periphery of the turntable 13. During this transport, the filling unit 15 fills the ampules a with a given type of liquid and the burner 16 heat seals the upper portions of the respective ampules a.

The ampules a thus filled and heat sealed are now transported along the guides 28, 29 to the screw conveyor 20 as the intermediate star wheels 24, 25 and then discharged by the screw conveyor 20 into a chute 32.

The upper portions of the ampules a burned off by the burner 16 are transported together with the pincers 14 pinching them as the turntable 13 further rotates and finally discharged through the discharging chute 19.

Figure 2:
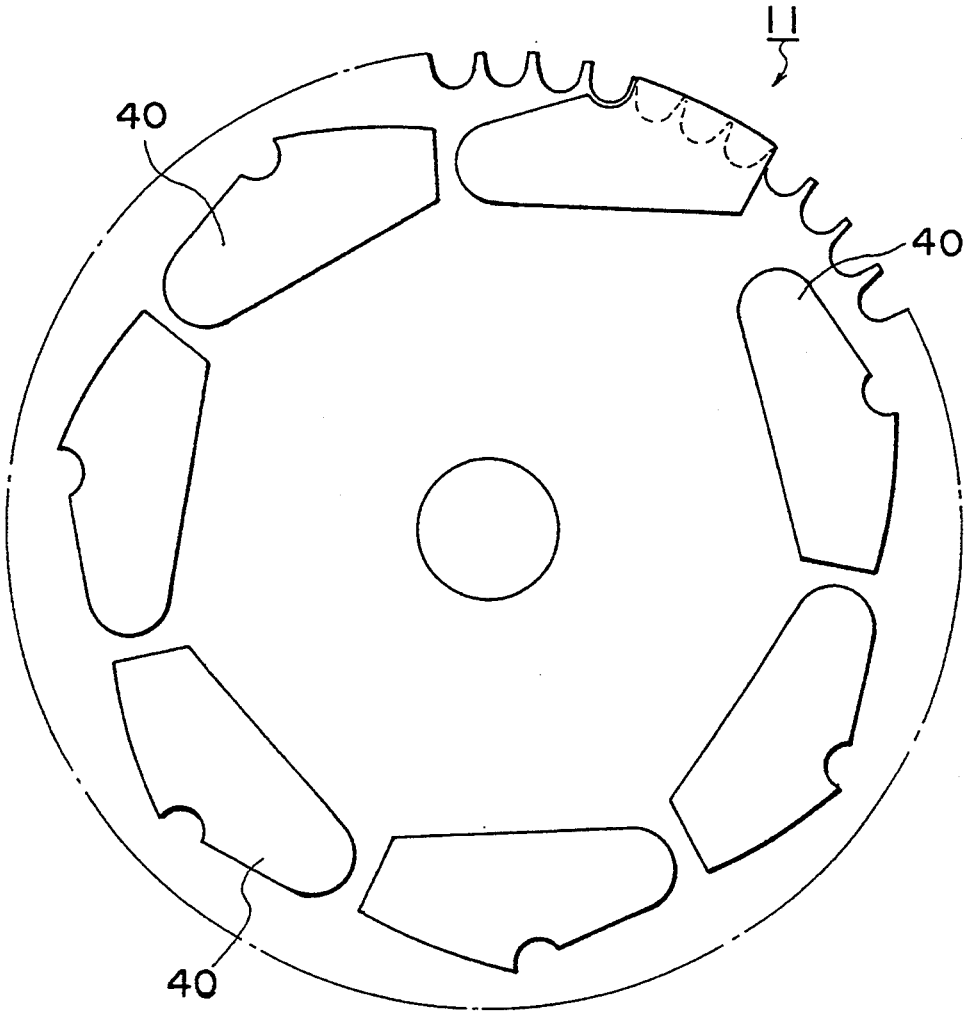
FIG. 2 is a plan view showing an embodiment of feed star wheel, provided with a plurality of shutters.

Referring to FIG. 2. The feed star wheel 11 carries a plurality of shutters 40 which may be pivotally rotated outward to close respective recesses 12 of the feed star wheel 11.

Figure 3:
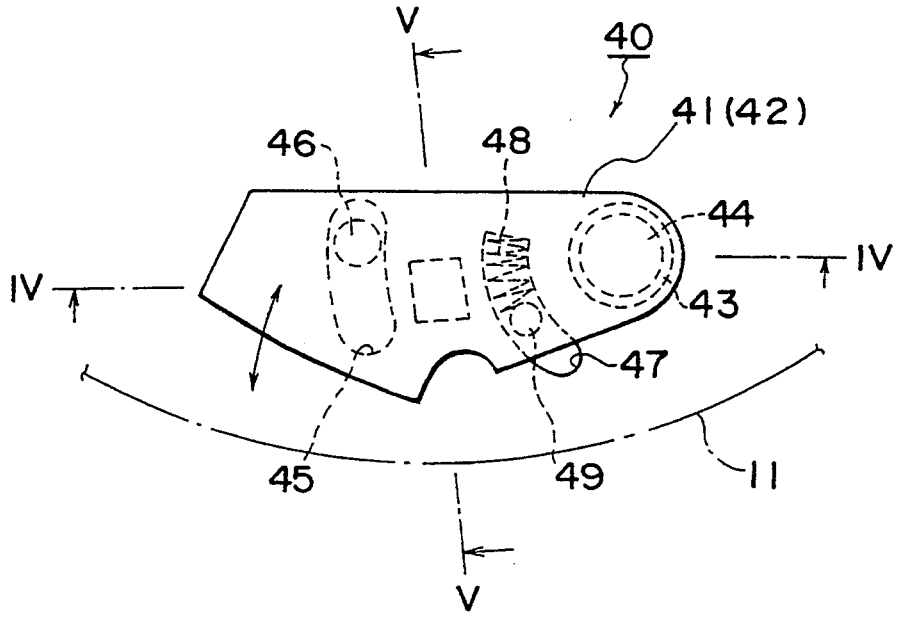
FIG. 3 is a plan view showing details of the shutter shown by FIG. 2.
Figure 4:
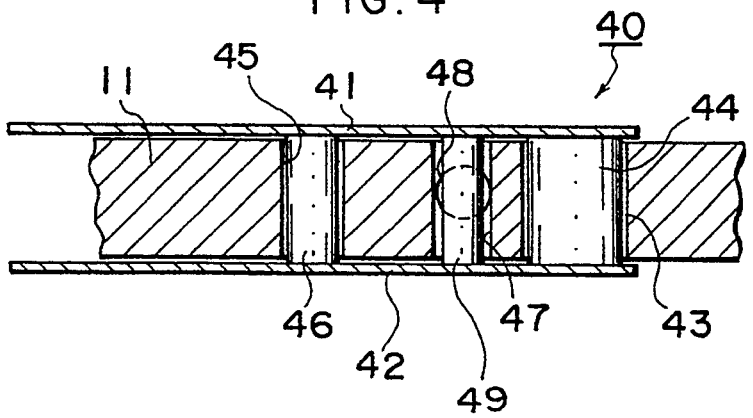
FIG. 4 is a sectional view taken along a line IV—IV in FIG. 3.

Referring to FIGS. 3 and 4, each shutter 40 comprises a pair of shutter plates 41, 42 vertically spaced from each other with the feed star wheel 11 located therebetween. These plates 41, 42 are fixed on upper and lower ends of a pivot pin 44 extending through a round hole 43 so as to be pivotally rotatable around the pivot pin 44. The feed star wheel 11 is formed with a slot 45 and a pin 46 connected between said paired shutter plates 41, 42 extends through said slot 45 so that the pivotal movement of the shutter plates 41, 42 can be limited. The feed star wheel 11 is further formed approximately midway between the round hole 43 and the slot 45 with a spring receiving hole 47 and a connector pin 49 connected between the paired plates 41, 42 is normally biased by a compression spring 48 provided within said hole 47 so as to be pivotally rotatable with respect to the feed star wheel 11.

Figure 5:
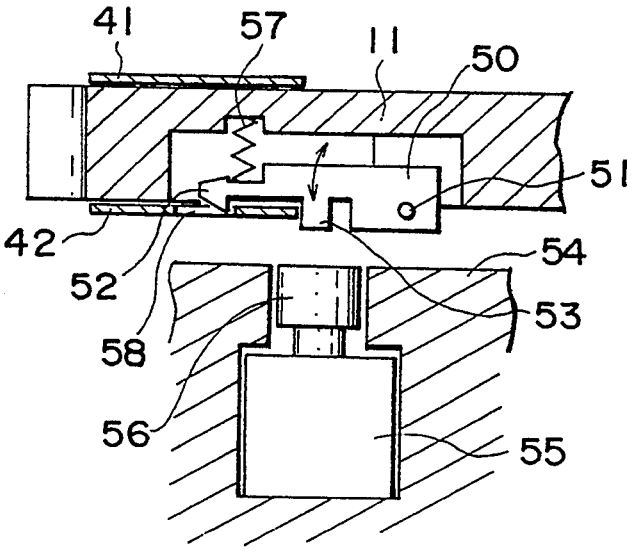
FIG. 5 is a sectional view taken along a line V—V in FIG. 3.
Figure 6:
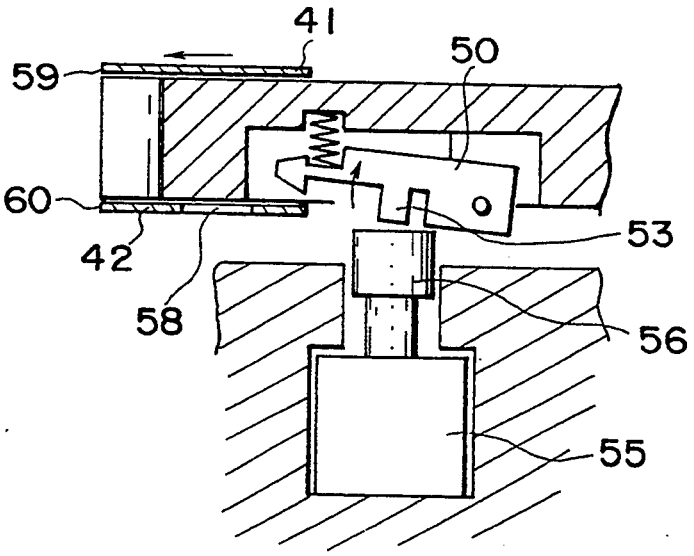
FIG. 6 is a plan view illustrating an operative association of a piston rod 56 and a stopper 50 in FIG. 5.

Referring to FIGS. 5 and 6, a mechanism for pivotally moving the shutter 40 outward with respect to the feed star wheel 11 will be described. On the underside of the feed star wheel 11, a stopper 50 is mounted on a pivot pin 51. The stopper 50 is formed on its forward end with it pawl 52 directed downward and a projection 53 lying midway between said pawl 52 and said pivot pin 51.

A stand 54 for the filling/sealing apparatus contains therein a cylinder 55 which has a piston rod 56 on its top and said projection 53 of the stopper 50 lies just above the piston rod 56.

When the piston rod 56 takes its retracted position, the stopper 50 is biased downward, by a spring 57 provided above the stopper 50 and the pawl 52 on the forward end of the stopper 50 is engaged with a window hole 58 formed in the shutter plate 42, as shown by FIG. 5, preventing the paired shutter plates 41, 42 from being pivotally rotated outward under the biasing effect of the compression spring 48. Position taken by the shutter plates in this state is shown by single-dot chain line 41' (42') in FIG. 7.

Figure 7:
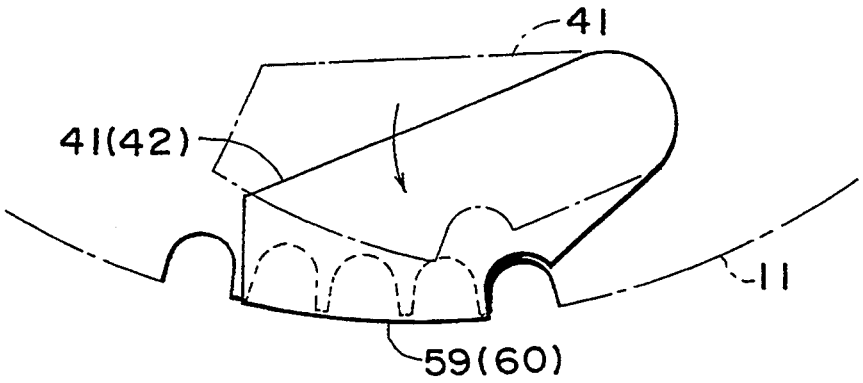
FIG. 7 is a plan view illustrating a manner in which the shutter of FIG. 3 operates.

When the piston rod 56 is extended to urge the stopper 50 upward by the projection 53, as shown by FIG. 6, the pawl 52 is disengaged from the window hole 58 and the shutter plates 41, 42 are freely rotated outward with respect to the feed star wheel 11 under the biasing force of said compression spring 48 (see FIGS 3 and 4) to the position as shown by a solid line 41 (42) in FIG. 7. In this position, edges 59, 60 of the respective shutter plates 41, 42 close the associated recesses 12 formed along the peripheral surface of the feed star wheel 11.

Figure 8:
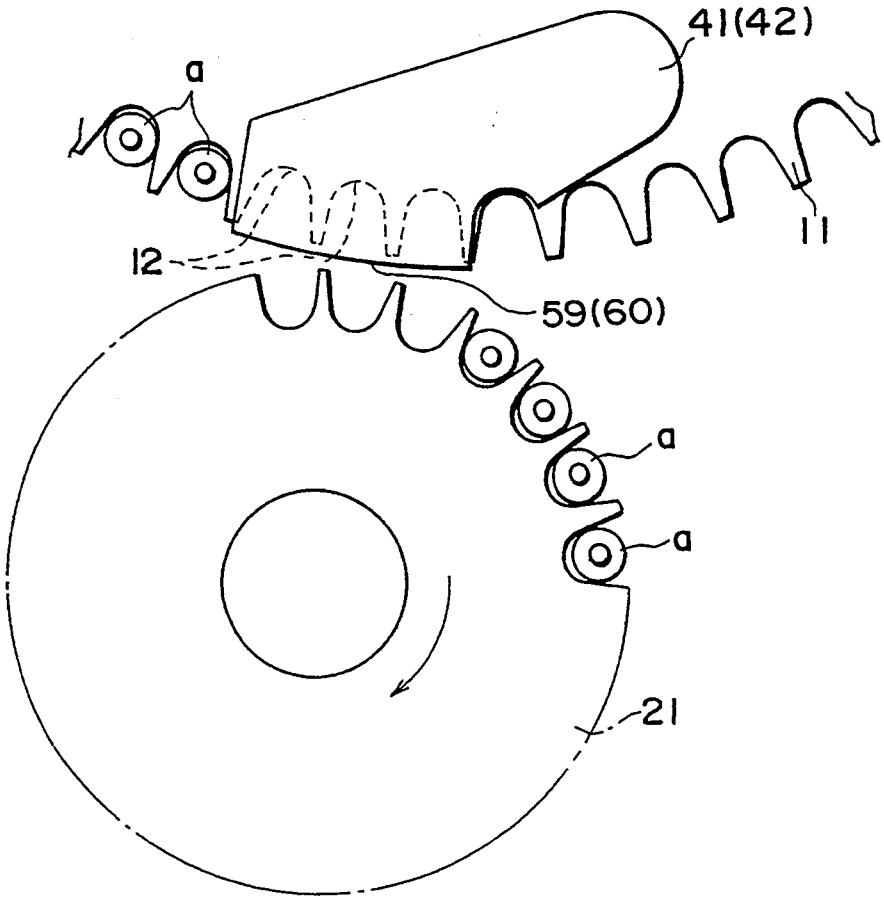
FIG. 8 is a plan view illustrating an operative association of the shutter of FIG. 7 and an intermediate star wheel 21.

FIG. 8 shows a state at which the shutter plates 41, 42 have been rotated outward in the manner as described above and consequently further feeding of the ampules a from the feed star wheel 11 to the intermediate star wheel 21 has been interrupted. As shown, the edges 59, 60 of the respective shutter plates 41, 42 close the associated recesses 12 to prevent further ampules a from being received by these recesses 12 and rotation of the feed star wheel 11 is stopped when the recesses 12 holding no ampule a come to a point of tangency to the intermediate star wheel 21.

The intermediate star wheel 21 continues to be rotated to the contrary. No ampule a is present at the point of tangency between the feed star wheel 11 and the intermediate star wheel 21 since the recesses 12 of the feed star wheel 11 at this position have been closed by the edges 59, 60 of the respective shutter plates 41, 42 and thereafter no more ampule a is Fed from the feed star wheel 11 to the intermediate star wheel 21.

The ampules a having already been delivered to the intermediate star wheel 21 are transported, as the intermediate star wheel 21 is rotated, to the turntable 13 where these ampules a are subjected to liquid filling and sealing.

Such arrangement that further rotation of only the feed star wheel 11 having its recesses 12 closed by the shutter plates 41, 42 is stopped and thereby feeding of additional ampules a is interrupted is advantageous in that the ampules a having already been delivered to the intermediate star wheel 21 are subjected to the processes of liquid filling and sealing since the intermediate star wheel 21 continues to be rotated. In this manner, the apparatus as a whole is never stopped in the course of these processes and therefore no deficient ampule is produced.

Now a mechanism adapted to determine whether the respective ampules a have their heads a or not and put any deficient ampules a out off the way will be described in reference with FIGS. 9 through 11.

Figure 9:
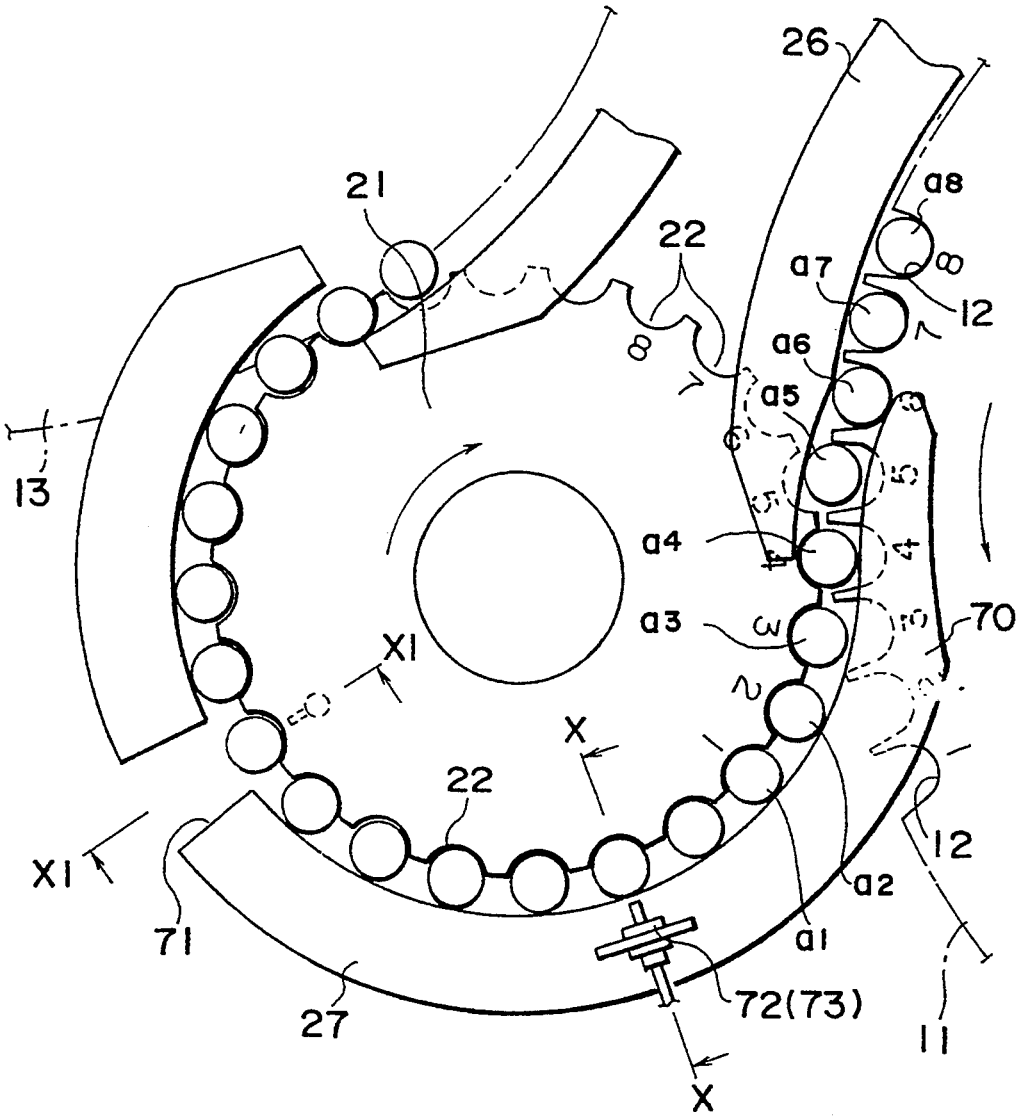
FIG. 9 is a plan view of the intermediate star wheel.

FIG. 9 is a plan view or the intermediate star wheel. As shown, the ampules a having been transported by the recesses 12 of the feed star wheel 11 along the guide 26 are then guided by the guide 70 defined by the forward end of the guide 27 into the respective recesses 22 of the Intermediate star wheel 21. The guide 27 is divided by a gap 71 into two sections.

Figure 10:
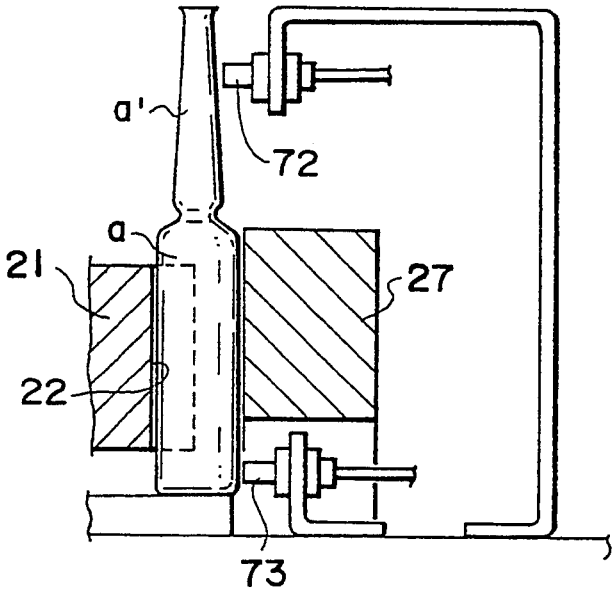
FIG. 10 is a sectional view taken along a line X—X in FIG. 9, showing sensors serving to detect the presence of a head a' of the ampules a, FIG. 11 is a sectional view taken along a line XI—XI in FIG. 9 showing a nozzle used to put a deficient ampule a'' out of the way.

Referring to FIG. 10, there are provided sensors 72, 73 to detect whether the ampules a have their heads a' or not. If both the upper and lower sensors 72, 73 detect the existence of an ampule, it will be determined that this ampule is acceptable and, if the upper sensor 72 detects the absence of an ampule while the lower sensor 73 detects the presence of an ampule, it will be determined that this ampule is deficient one having no head a'. It should be understood that, if both the upper and lower sensors 72, 73 detect the absence of an ampule, it will be determined that there is no ampule and the process of liquid filling will be prohibited.

Figure 11:
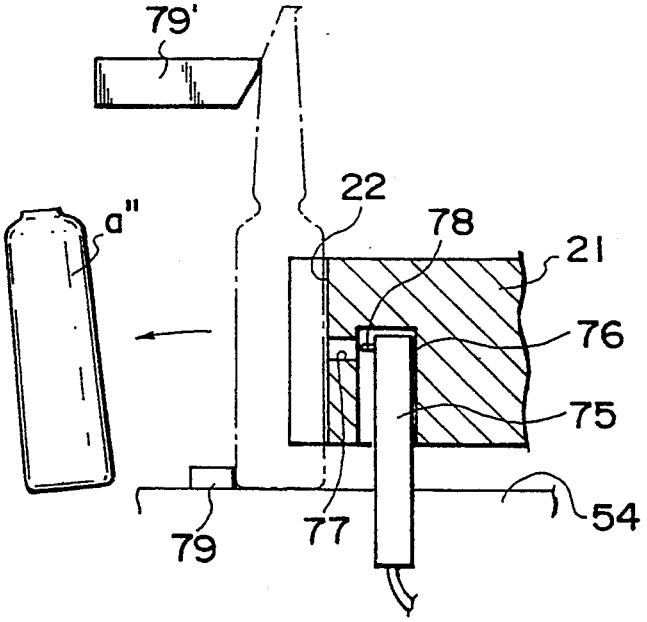

Referring to FIG. 11, there is provided in the gap 71 a nozzle 75 serving for removal of the deficient ampule a'' having no head a'.

As shown, the nozzle 75 extends upward from the stand 54 (also see FIG. 5) for the filling/sealing apparatus into an annular groove 76 formed in the underside of the intermediate star wheel 21 and has a spout 78 mounted on the upper end of the nozzle 75 so as to be directed to a through-hole 77 extending from the annular groove 76 to the recess 22.

When the ampule a'' that has been determined by the sensor 72, 73 to be a deficient ampule having no head reaches the gap 71 of the guide 27, the spout 78 on the upper end of the nozzle 75 emits an air jet to blow off the deficient ampule a'' beyond an outer bottom guide 79. The normal ampule, on the other hand, is reliably guided by said bottom guide 79 and a head guide 79', and passes by the gap 71, as shown by FIG. 11.

Figure 12:
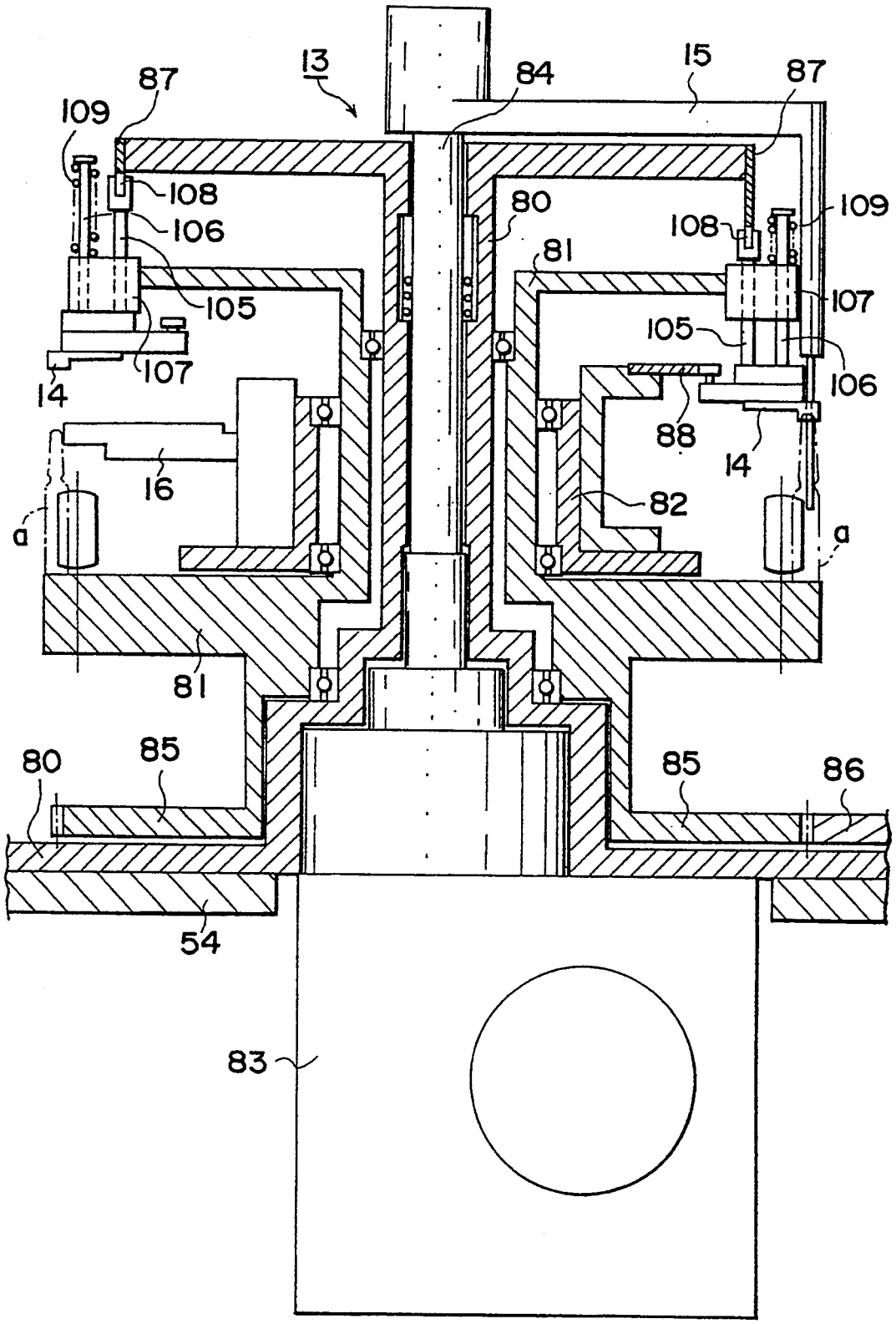
FIG. 12 is an axial sectional view of a turntable.

FIG. 12 is as an axial sectional view of the turntable 13. A main body 81 of the turntable 13 is rotatably mounted on a bearing 80 which is, in turn, fixed to the stand 54 of the filling/sealing apparatus. A stationary member 82 is mounted around the main body 81 of the turntable 13. It should be understood that the stationary member 82 is fixed by an arm (not shown) extending from the stand 54.

A drive shaft 84 axially extends through the bearing 80 to drive a pick-and-place unit (a drive unit for rotational and vertical movement) 83 and carries on its upper end the filling unit 15 used to fill the ampules a with a given type of liquid. The stationary member 82 carries the burner 16 to heat seal the upper end of the ampule a. In addition, the bearing 80 carries a cam 87 used to move the pincers in vertical direction and the stationary member 82 carries a cam 88 used to open and close the pincers.

Rotation of a driving gear 86 is transmitted to a gear 85 formed by a bottom of the turntable's main body 81 rotatably supported between the bearing 80 and the stationary member 82 and thereby the turntable's main body 81 is rotated. The turntable's main body 81 carries the pincers 14 adapted to pinch the upper end of the ampule a while the ampule a is transported as the turntable's main body 81 is rotated.

Figure 13:
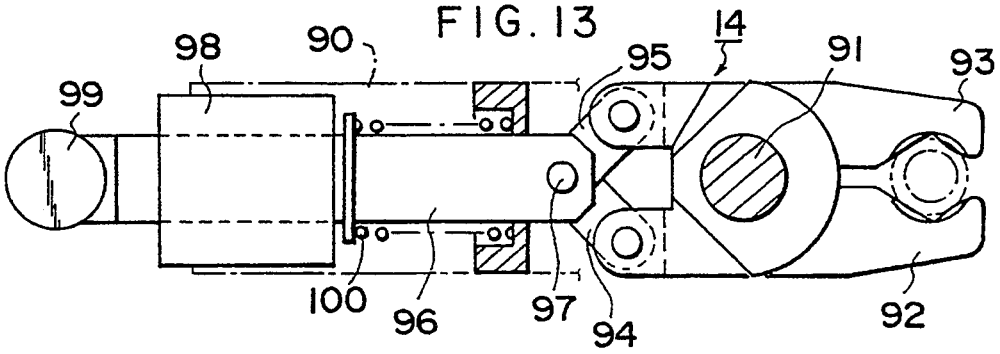
FIG. 13 is a plan view showing pinch hands 92, 93 of each pincers 14 in their closed positions.
Figure 14:
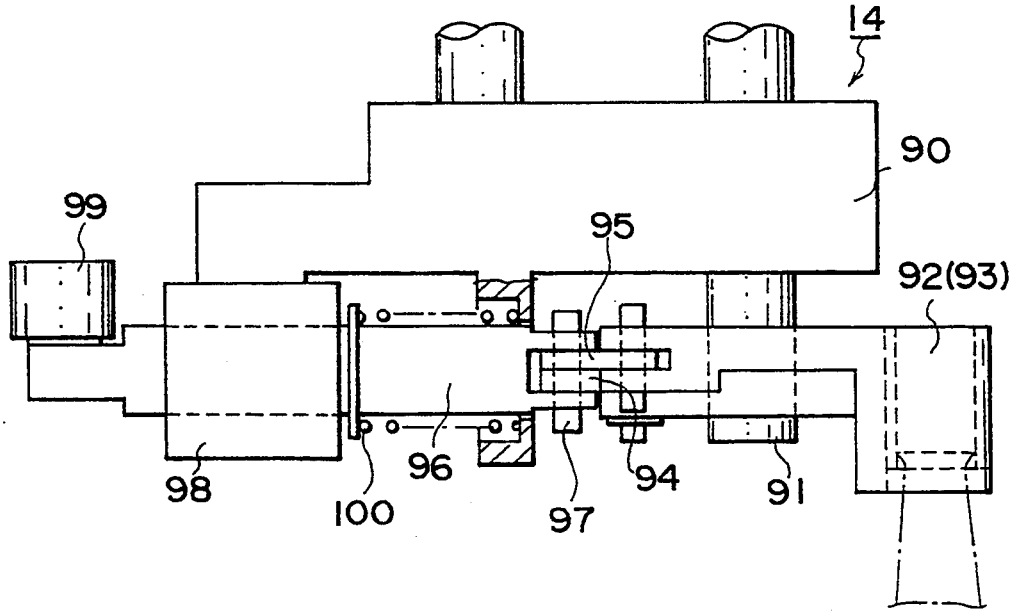
FIG. 14 is a side view corresponding to FIG. 13.

Referring to FIGS. 13 through 17, the manner in which the pincers 14 operate will be described. As shown by FIGS. 13 and 14, a base end 90 of the pincers is provided with a shaft 91 vertically extending downward, and right and left pinch hands 92, 93 are pivotally mounted on this shaft 91 so as to cross each other. Arms 94, 95 pivotally connected to the base ends of these pinch hands 92, 93 are connected on a pivot pin 97 which is, in turn, mounted on the forward end of a rod 96 supported by a bushing 98 mounted on the base end 90 of the pincers in longitudinally movable manner. The rod 96 is provided on its rear end with a follower 99 adapted to be engaged with the cam 88 (see FIGS. 12 and 15) used to open and close the pincers so that the follower 99 is normally biased by a spring 100 wound around the rod 96 in a direction away from the pinch hands 92, 93.

Figure 15:
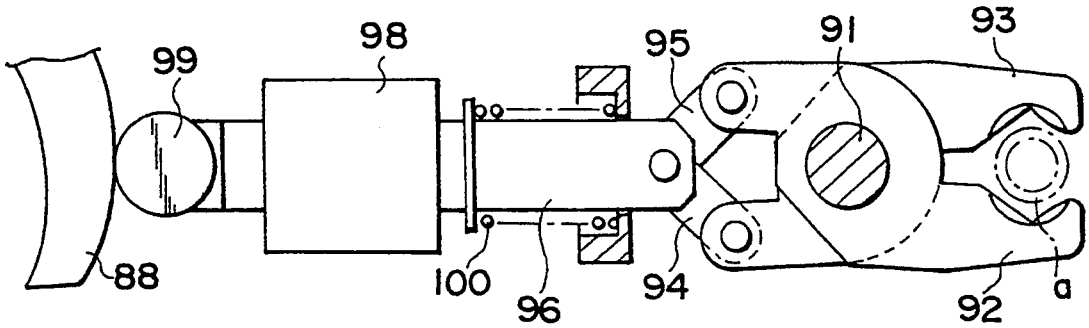
FIG. 15 is a plan view showing the pinch hands 92, 93 of the pincers 14 in their opened positions.

FIG. 15 shows the state in which the follower 99 comes in engagement with the cam 88 used to open and close the pincers and consequently the rod 96 is moved back against the force of the spring 100 toward the pinch hands 92, 93.

As the rod 96 is moved back by the earn 88 used to open and close the pincers toward the pinch hands 92, 93, the arms 94, 95 and the pinch hands 92, 93 are pivotally rotated to separate the forward ends of the respective pinch hands 92, 93 from each other so that the upper ends of the ampule a may be received between the pinch hands 92, 93.

It is effective to pinch the upper end of the branch portion of ampules by pinch hands, 92, 93 of pincer 14 (see FIG. 14) in order to determine the center position of the ampules when nitrogen gas or fluid is being fed into each ampule. Namely, when the body portion, is pinched by pinch hands 92, 93, the center of branch portion of an ampule and the center of a filling needle 127 (see FIG. 20) don't correspond to each other because of inaccuracy in production process, sometimes resulting in damaging the branch portion of ampules by filling needles 127. However, by pinching the branch portion of the ampules by pinch hands 92, 93, the center of the branch portion of the ampules is determined with accuracy, therefore stable filling of the nitrogen gas or fluid into ampules is achieved without having any inefficiency in inserting filling needles 127 into the ampules.

The pincers 14 are mounted on lower ends of two guide rods 105, 106, respectively, as shown by FIG. 12 and these guide rods 105, 106 are supported by a bearing 107 formed on the turntable's main body 81 in vertically movable manner. The guide rod 105 carries on its upper end a follower 108 adapted to be engaged with the cam 87 used to move the pincers up- and downward while the guide rod 106 carries therearound a spring 109 normally biasing the pincers 14 upward.

Figure 16:
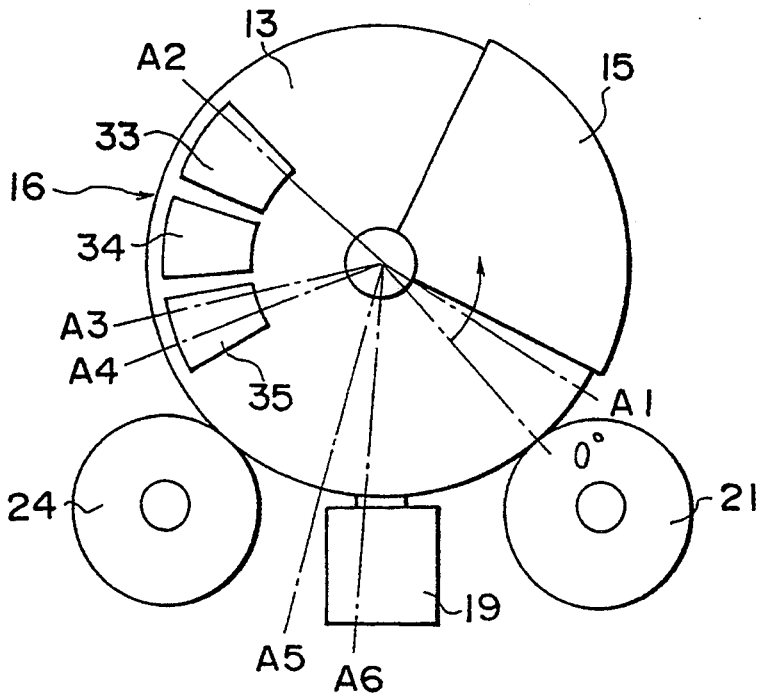
FIG. 16 is a plan view illustrating an operative association of a cam 87 serving to move the pincers up- and downward, a cam 88 serving to open and close the pincers, and the turntable.

Then it will be discussed how the cam 87 used to move the pincers up- and downward and the cam 88 used to open and close the pincers operate. Referring to FIG. 16, assumed that the point of tangency, between the intermediate star wheel 21 and the turntable 13 is taken as a point of within (0°) and the counterclockwise rotation is considered as the rotation in positive direction, the cam 88 used to open and close the pincers is high at the point of origin (0°) (i.e., the pinch hands 92, 93 have their forward ends sufficiently separated away from each other to receive the upper end of the ampule a) and, at a position A1 slightly advanced from the point of origin (0°), the cam 88 is low (i.e., the pinch hands 92, 93 have their forward ends moved toward each other sufficiently to pinch the upper end of the ampule a). At a position A2 adjacent the first burner section 33 of the burner 16, the cam 88 becomes high again (i.e., the pinch hands 92, 93 have their forward ends separated away from each other sufficiently to release the upper end of the ampule a) and, at a position A3 adjacent the third burner section 35, the cam 88 becomes low again (i.e., the pinch hands 92, 93 have their forward ends moved again toward each other sufficiently to pinch the upper end of the ampule a). The cam 88 becomes high again (i.e., the pinch hands 92, 93 have their forward ends separated away from each other) at a position A6 adjacent the discharging chute 19 (See FIG. 17).

Figure 18:
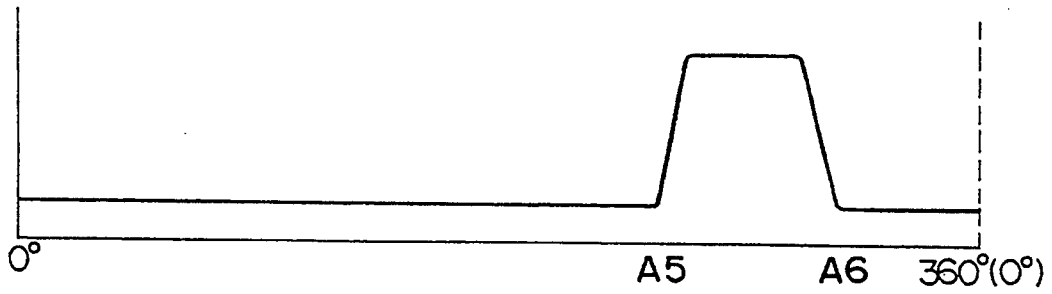
FIG. 18 is a graphic diagram showing operation of the cam 87 serving to move the pincers up- and downward.
Figure 35:
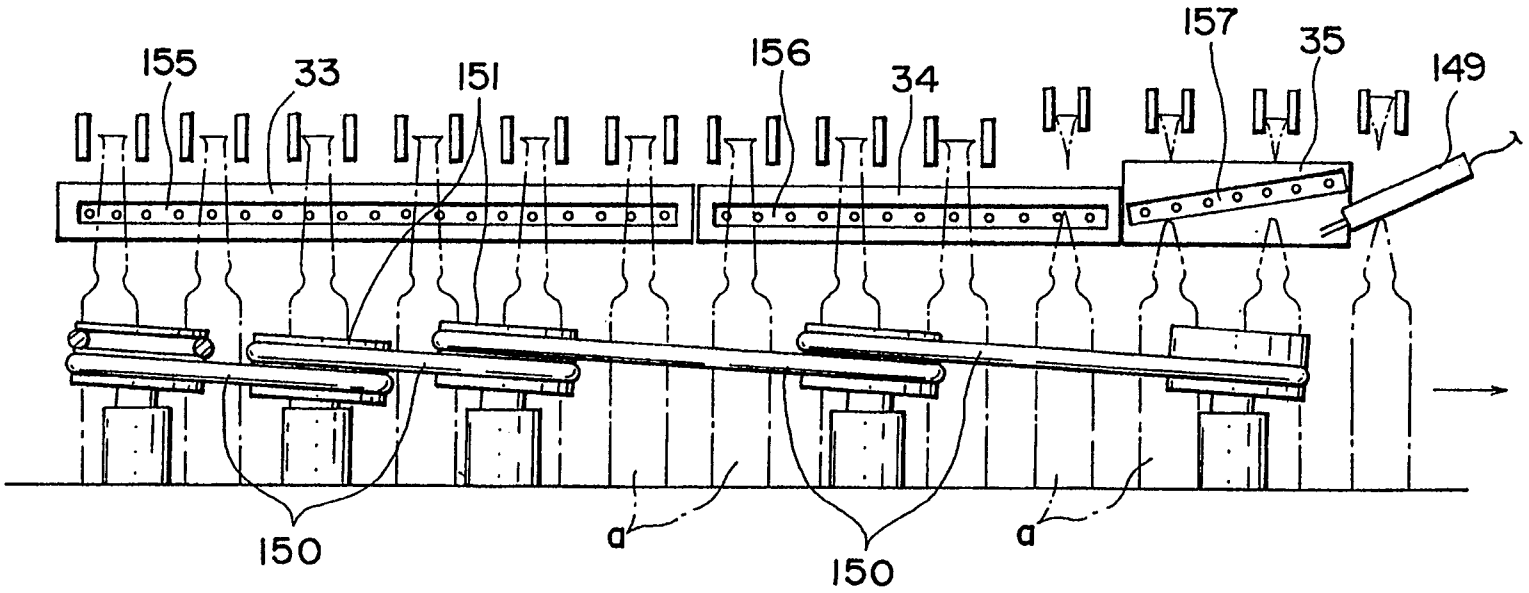
FIG. 35 is a front view off the burner 16 shown by FIG. 34.

The cam 87 used to move the pincers up- and downward is low (i.e., the pincers 14 can pinch the upper end of the ampule a) at the point of origin (0°), then becomes high (i.e., the pincers 14 lies above the upper end of the ampule a) at the position A3 and becomes low again at a position A5 (See FIGS. 18 and 35).

Now the ampule a is filled with a given type of liquid and gaseous nitrogen in a manner as will be described in reference with FIGS. 19 though 33.

Figure 19:
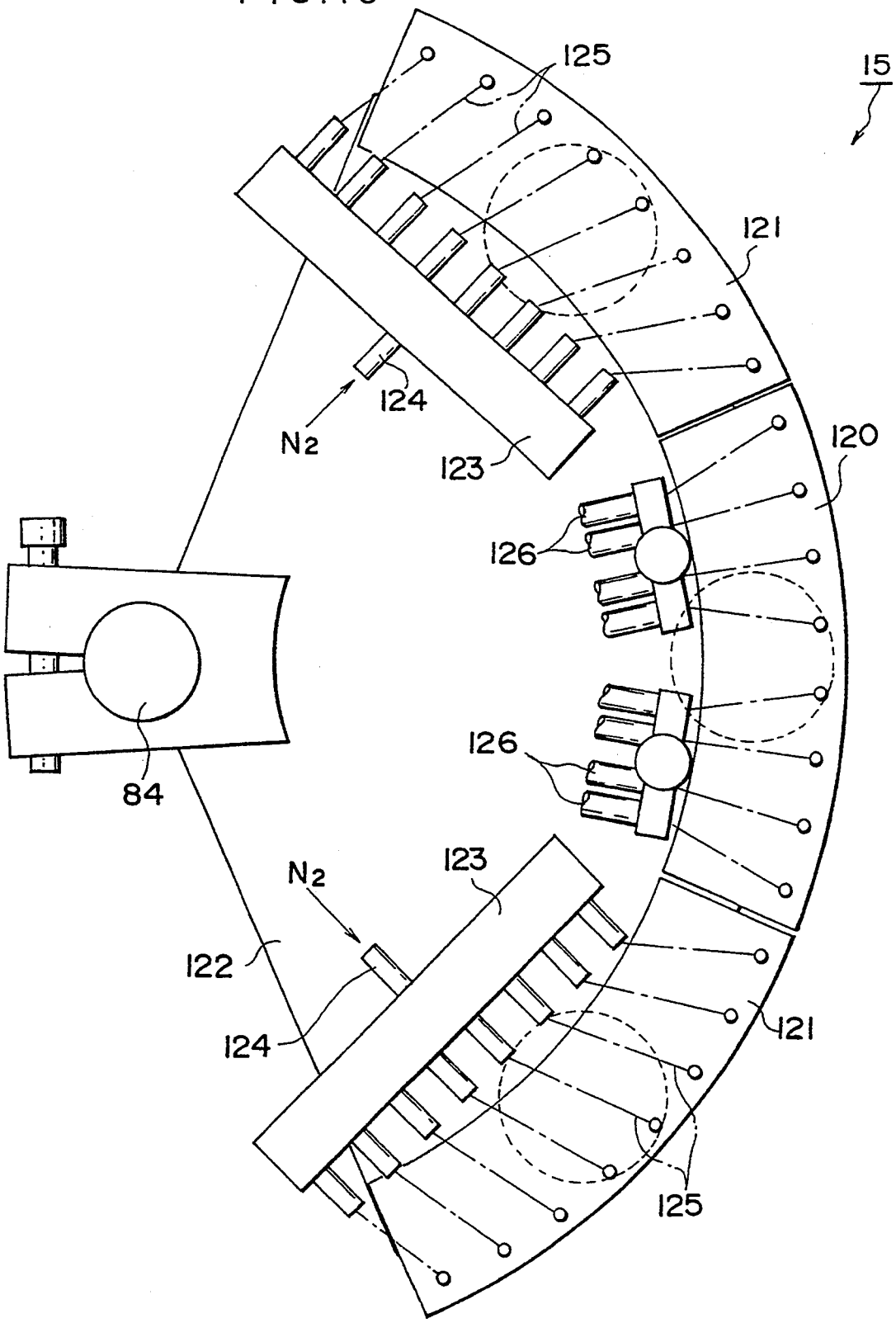
FIG. 19 is a plan view showing a liquid filling unit 120 and a gaseous nitrogen filling unit 121 within filling unit 15.

Referring to FIG. 19, the filling unit 15 is centrally provided with a liquid filling unit 120 and lateral thereof with a pair of gaseous nitrogen filling units 121, 121, respectively. These units 121, 120, 121 are mounted on a sector plate 122 which is, in turn, fixed on the upper end of the drive shaft 84 for the pick-and-place unit 83 shown by FIG. 12 so that the respective units 121, 120, 121 may be rotated together with the ampules a transported by the turntable 13 and simultaneously ascend and descend as the pick-and-place unit 83 is driven.

There are provided manifolds 123, 123 behind the respective gaseous nitrogen filling units 121, 121 and in each of these manifolds a stream of gaseous nitrogen injected through a passage 124 is distributed into eight tubes 125 before being fed into the gaseous nitrogen filling unit 121.

The liquid is fed from the liquid feed pump 17 shown in FIG. 1 to the liquid filling unit 120 via eight hoses 126.

Figure 20:
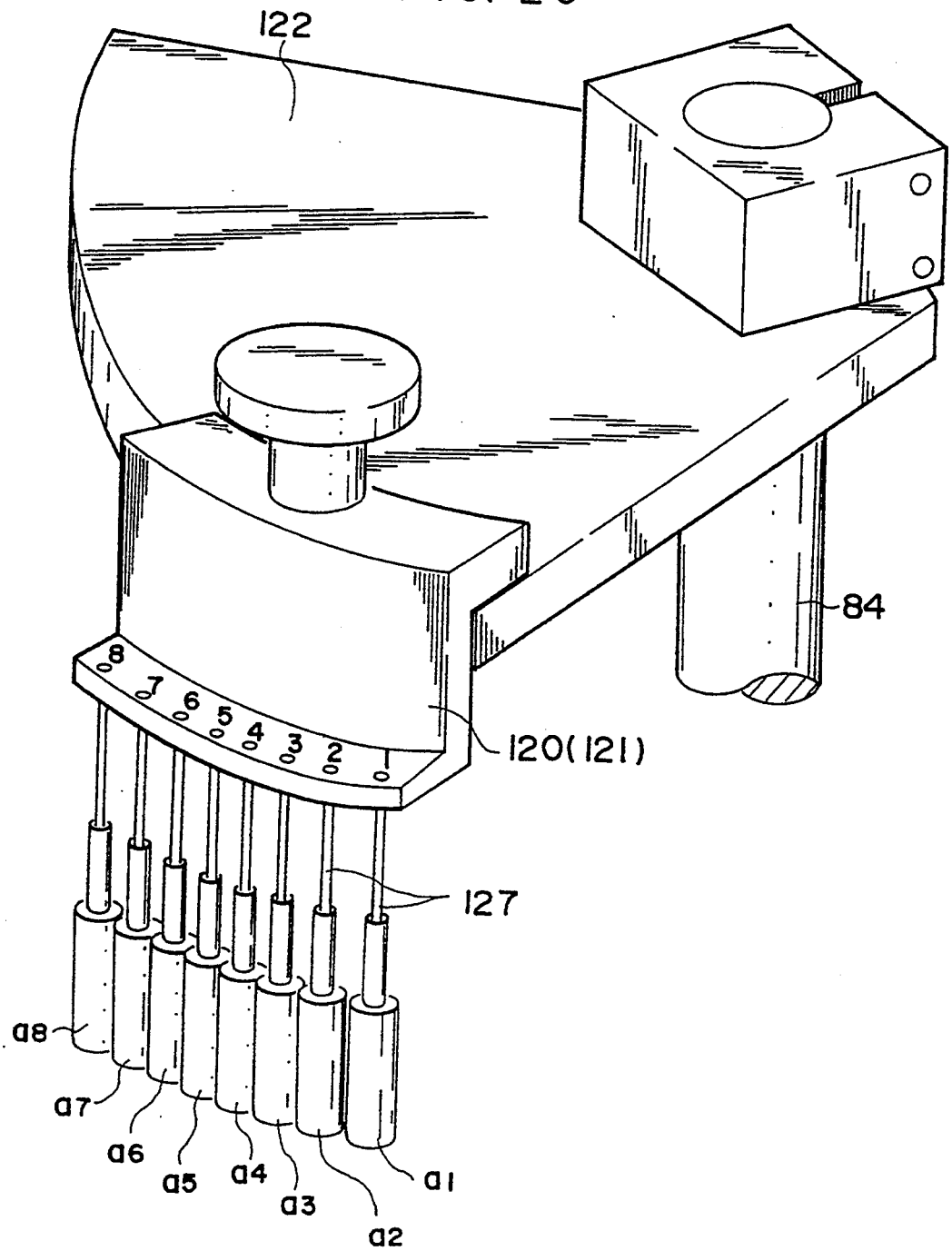
FIG. 20 is a perspective view corresponding to FIG. 19.

FIG. 20 is a perspective view of such liquid filling unit 120 and gaseous nitrogen filling unit 121. As shown, each of these units 120, 121 is provided on the underside with eight filling needles 127 to which the gaseous nitrogen or the liquid is fed through the above-mentioned tubes 125 or hoses 126, respectively. The filling needles 127 associated with each unit 120, 121 then inject the liquid or the gaseous nitrogen, respectively, into the ampules a being transported by the turntable 13.

Figure 21:
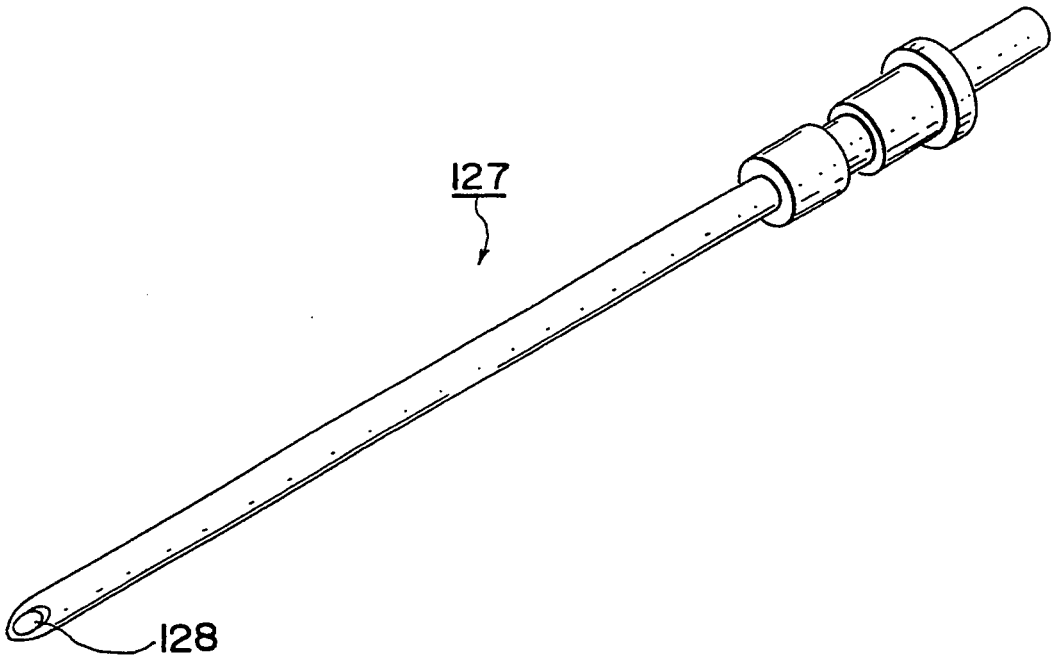
FIG. 21 is a perspective view showing a first embodiment of the filling needle in FIG. 20.
Figure 22:
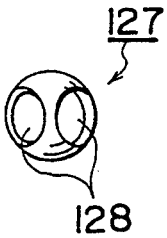
FIG. 22 is a front view showing a first embodiment of the filling needle in FIG. 20.

Each liquid filling needle 127 has a pair of spouts 128 laterally opened on its forward end, as shown by FIGS. 21 and 22, so that the liquid fed from the liquid feed pump 17 may be jetted from these spouts 128 obliquely downward against inner side wall of the ampule a and flow down against the inner side wall.

Figure 24:
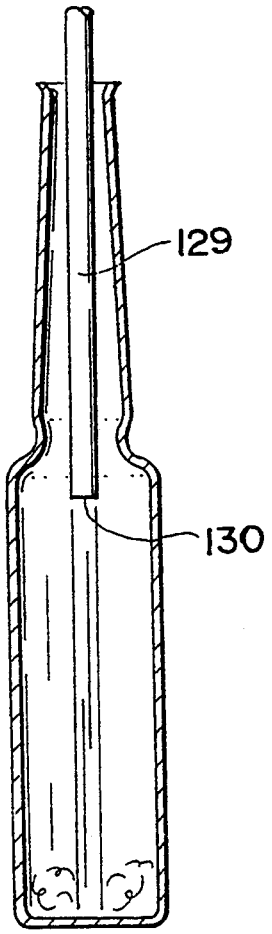
FIG. 24 PRIOR ART
FIG. 24 is an axial sectional view showing a filing needle of prior art.

With the conventional filling needle 129 having a spout 130 downwardly opened the liquid is vigorously jetted down in vertical direction against the bottom of the ampule a, as shown by FIG. 24, often resulting in problems such as foaming and liquid drip occurring after completion of filling.

Figure 23:
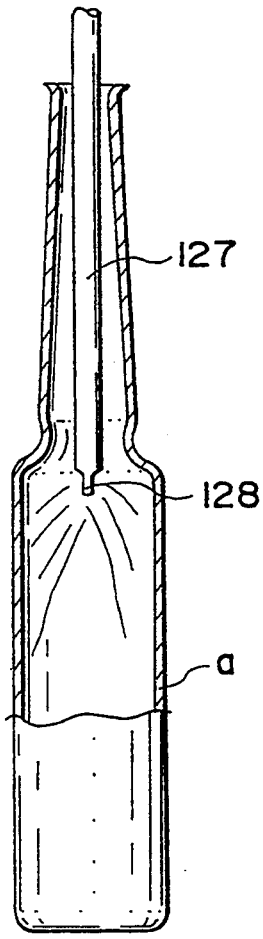
FIG. 23 is a front view illustrating, as partially broken away, a manner in which the filling needle of FIG. 21 operates.

FIGS. 21 and 22 show a first embodiment of the filling needle, particularly of the spout thereof. In this embodiment, each spout 128 is laterally opened so that the liquid may be obliquely and downwardly jetted through the spout against the inner side wall of the ampule a as shown by FIG. 23 and thereby not only said foaming may be avoided but also said liquid drip occurring after completion of filling may be substantially eliminated.

The first embodiment having a pair of spouts 128 as has been described above is suitable for the ampule of relatively small volume in the order of 1 to 5 ml.

Figure 25:
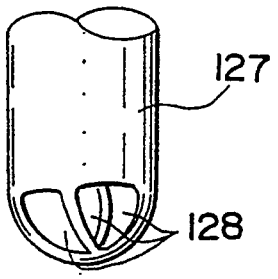
FIG. 25 is a side view showing a second embodiment of the filling needle.
Figure 26:
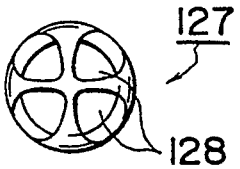
FIG. 26 is a front view showing the filling needle of FIG. 25.

The spout 128 of the filling needle may be selectively configured. For example, FIGS. 25 and 26 show a second embodiment of the spout configuration, in which the forward end of the filling needle 127 has four spouts 128 each laterally opened so that the liquid may be jetted from each spout 128 obliquely downward. This embodiment is suitable for use with the ampule of relatively large volume in the order of 10 to 30 ml.

Figure 27:
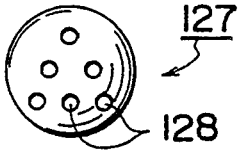
FIG. 27 is a front view showing a third embodiment of the filling needle.
Figure 28:
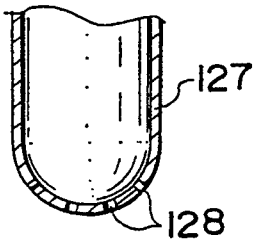
FIG. 28 is a sectional view showing the filling needle of FIG. 27.

FIGS. 27 and 28 show a third embodiment of the spout configuration, in which the forward end of the filling needle 127 has four or more spouts 128. This embodiment also is effective to avoid the previously mentioned problems such as foaming and liquid drip.

Then, the liquid feed pump serving to pump the liquid into the liquid filling unit will be described.

Figure 29:
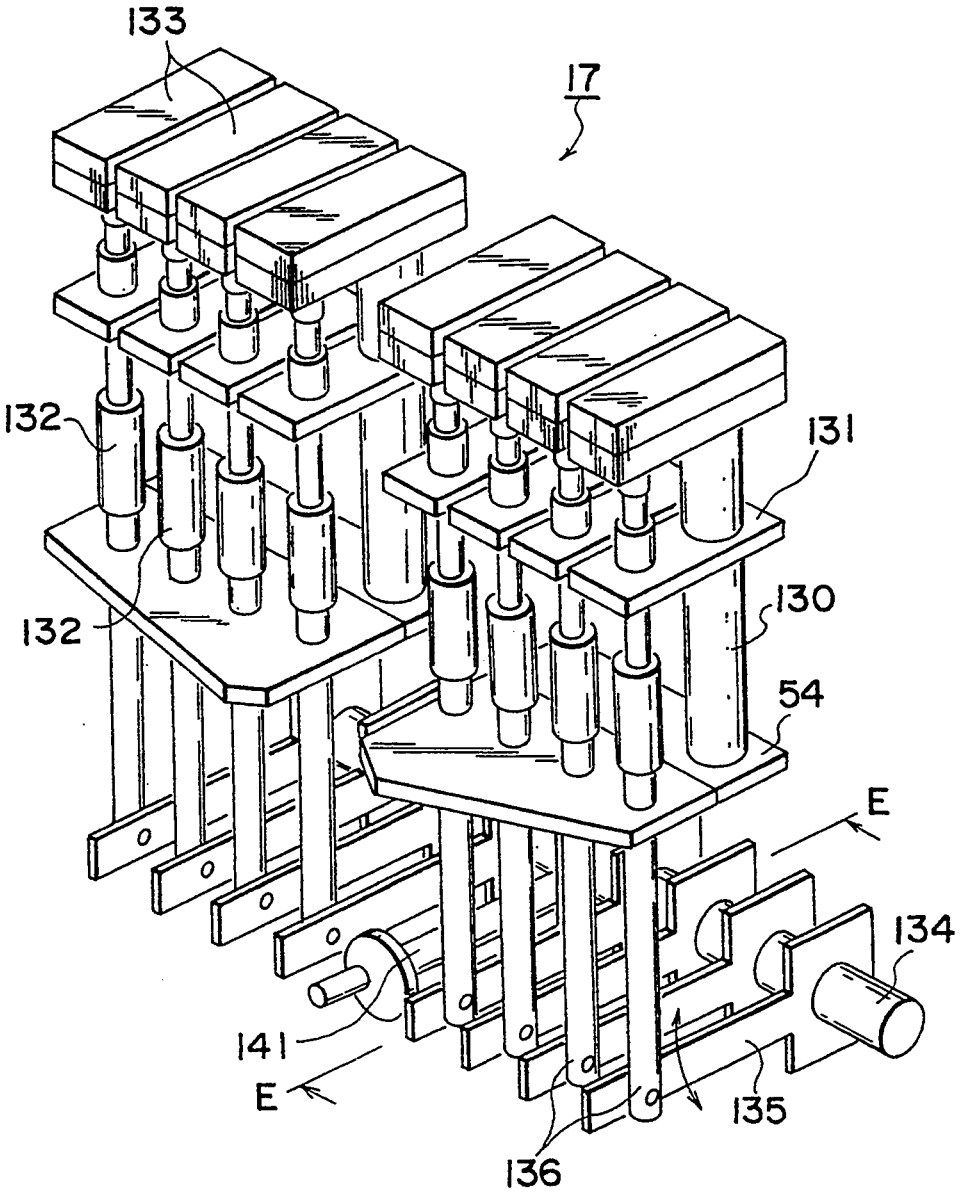
FIG. 29 is a perspective view of a liquid feed pump 17.
Figure 30:
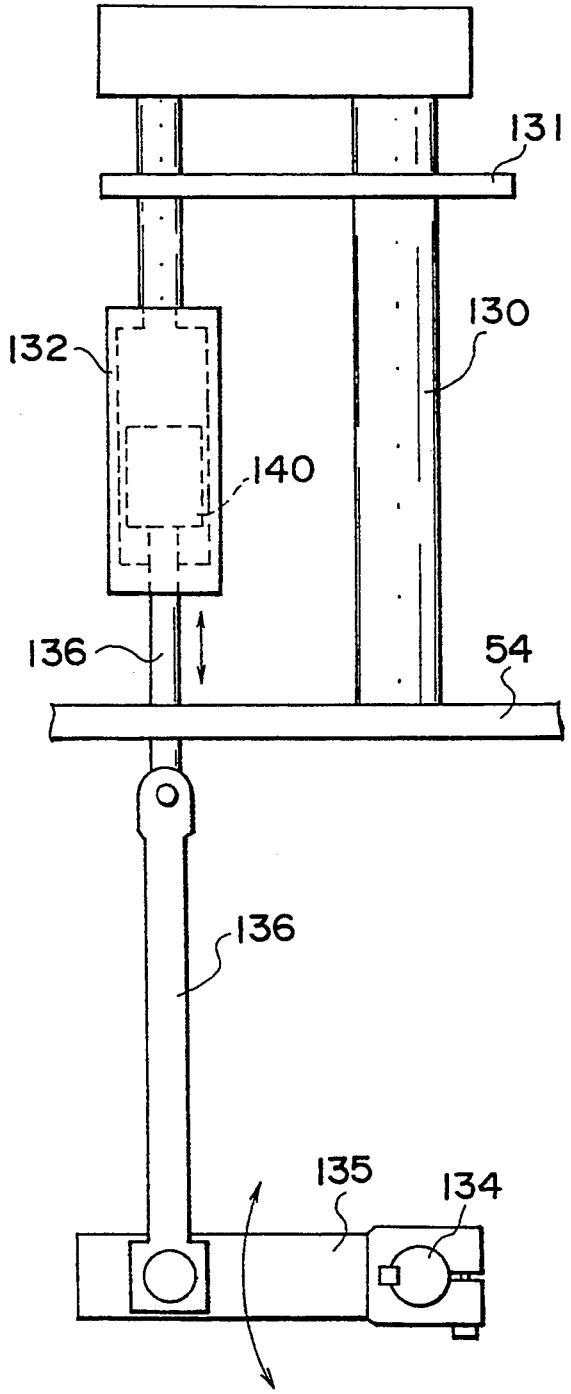
FIG. 30 is a side view showing the liquid feed pump 17 off FIG. 29.

FIGS. 29 and 30 are perspective and side views, respectively, showing the liquid feed pump 17 serving to pump the liquid into the eight filling needles 127 (see FIG. 20) of the liquid filling unit 120.

Eight posts 130 planted on the stand 54 for the filling-/sealing apparatus respectively support plates 131 which support, in turn, valve drive means 133. A cylinder 132 is interposed between each plate 131 and the stand 54 for the filling/sealing apparatus. Below the stand 54, there is provided an output shaft 134 extending transversely of the plates 131 and carrying eight arms 135 of which the free ends are connected to respective piston rods 136. The other ends of the piston rods 136 are connected to respective pistons 140 within the associated cylinders 132.

Figure 31:
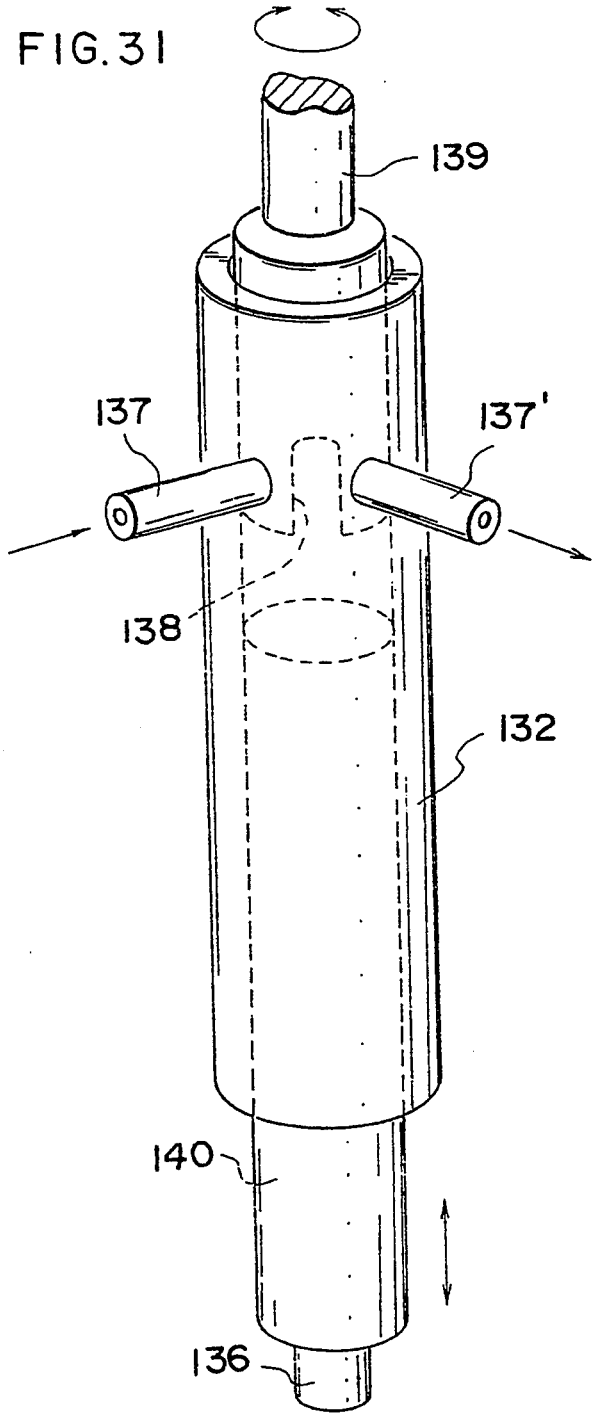
FIG. 31 is a perspective view of a cylinder 132 contained within the liquid feed pump 17.
Figure 32:
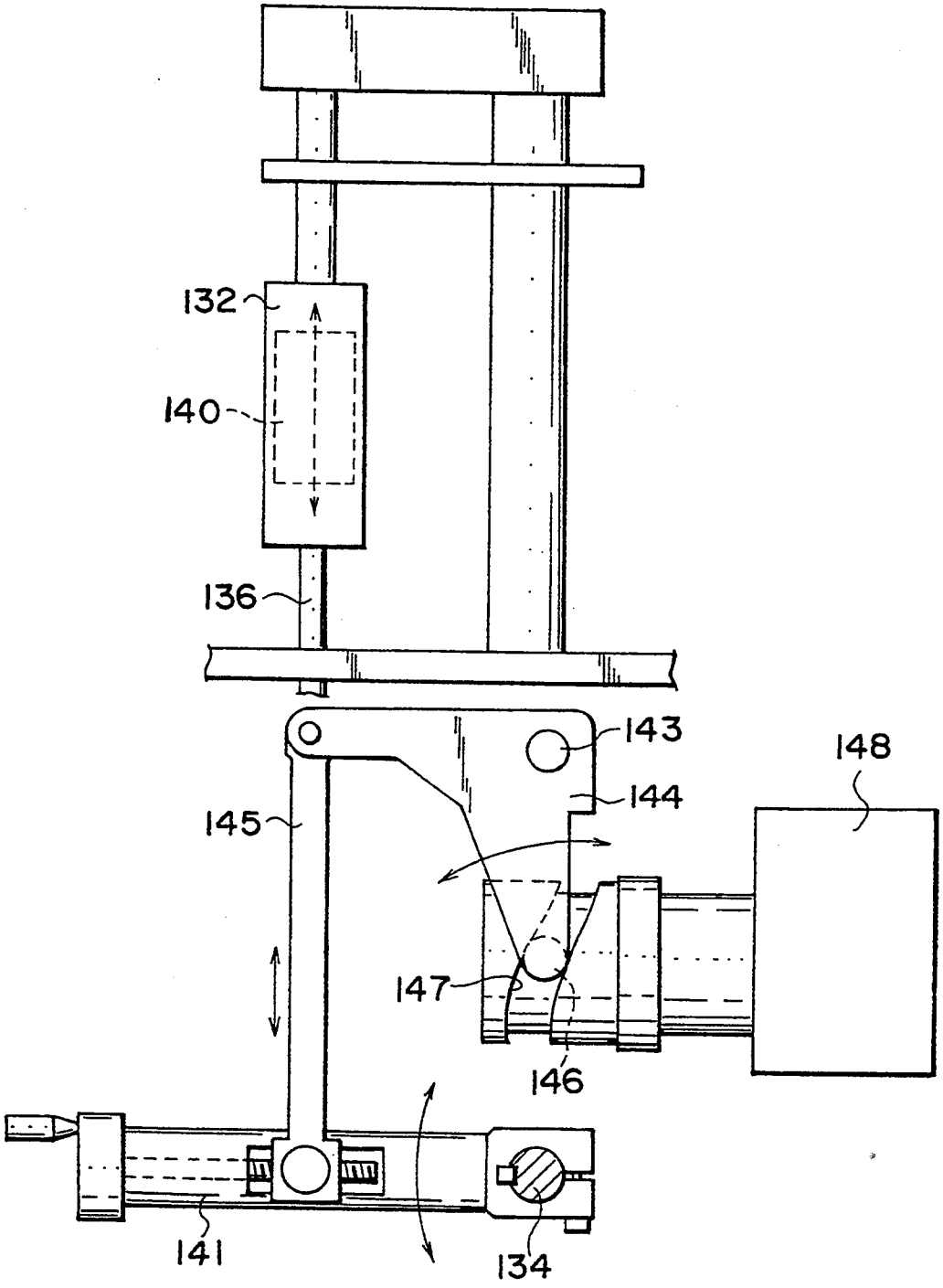
FIG. 32 is a side view illustrating an operative association of a follower 146 and a grooved cam 147.

As shown by FIG. 31, each cylinder 132 includes inlets and outlets 137, 137' for the liquid and the mode in which the cylinder 132 operates is changed by a switching valve 138 contained therein between a liquid suction mode and a liquid feed mode. A rotatable shaft 139 of the valve drive means 133 (see FIG. 29) is operatively connected to the switching valve 138. The upper end of the position rod 136 is connected to the piston 140 adapted to be received by the cylinder 132 from below. A drive arm 141 is operatively connected to the output shaft 134 at a longitudinally middle point of the latter. As will be apparent from FIG. 32, one end of each bell crank 144 pivotally mounted on a pivot pin 143 is connected by a con rod 145 to the drive arm 141. A Follower 146 mounted on the other end of the bell crank 144 is engaged with a grooved cam 147 which is rotatably driven by a drive system or motor 148 synchronized with rotation of the turntable's main body 81.

With such arrangement, as the grooved cam 147 is rotatable driven by the motor 148, the cell crank 144 is pivotally rotated within an angle as indicated by a double-headed arrow and the output shaft 134 is correspondingly rotated around its own axis. With a consequence, the eight arms 135 mounted on the output shaft 134 are pivotally rotated so as to move the pistons 140 mounted on the upper ends of the respective piston rods 136 in vertical direction. Thus the cylinders 132 cause the liquid to be fed through the respective liquid outlets 137' into the eight filling needles 127 carried by the liquid filling unit 120.

Immediately after the ampules a have been filled by the respective filling needles 127 with the liquid in the manner, the liquid is partially returned (i.e., sucked back) into the filling needles 127 in order to avoid the liquid drip.

Figure 33:
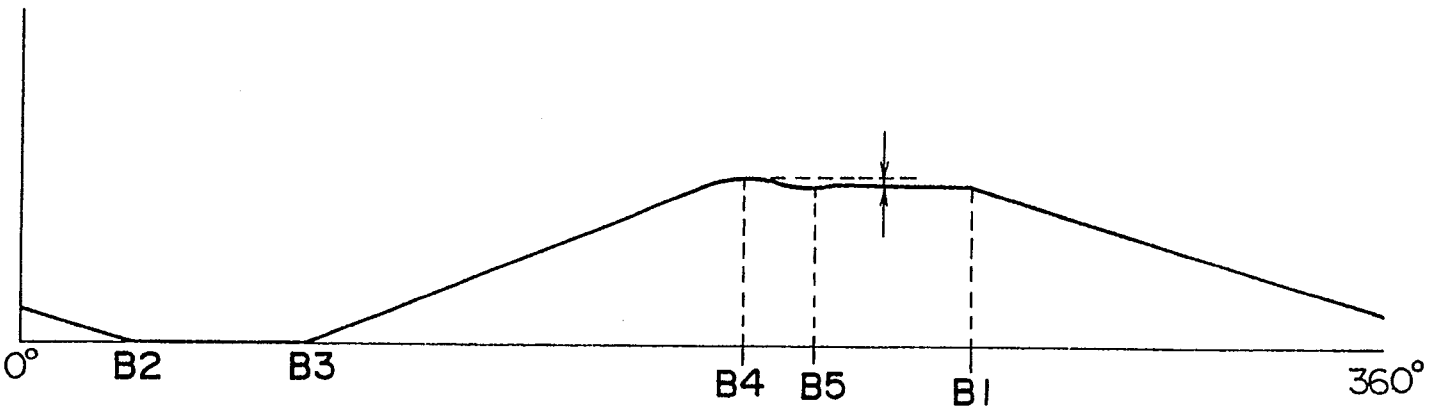
FIG. 33 is a cam diagram of the grooved cam 147.

FIG. 33 is a cam diagram of the grooved cam 147 serving to control the operation of liquid feeding as has been mentioned above. The respective pistons 140 descend and the liquid is sucked into the respective cylinders 132 through the inlets 137 as the grooved cam 147 is rotated by 360° from a position B1 at which the cam is relatively high to a position 32 at which the cam is lowest. The grooved cam 147 remains lowest over a range extending from said position 32 to a position 33 and, during a period corresponding to this range, switching between the inlets and outlets 137, 137' occurs under the action of the switching valve 138. Rotation of the grooved cam 147 from the position B3 to a position B4 at which the cam's height begins to increase causes the respective pistons 140 to ascend so that the liquid is fed into the respective filling needles 127 and then injected through the spouts 128 thereof into the eight ampules a.

The grooved earn 147 is highest at the position B4, immediately after which the cam's height slightly decreases, and then shifts to a position B5.

Such slight decrease in the cain's height generates a slightly negative pressure within each cylinder 132 and consequently the liquid is partially returned through the forward end of each filling needle 127 into the latter (i.e., so-called suck-back occurs) so that the liquid drip from the forward end of each filling needle 127 as well as the foaming may be effectively avoided. The filling operation made under control of the grooved cam in the manner as mentioned above is effective also to seal the upper open ends of the respective ampules a in an uniform shape without burning and to control a quantity of the liquid to be introduced into each ampule a with a high precision. It should be understood that the hoses 126 (see FIG. 19) must be uniformly dimensioned both in diameter and in length in order to stabilize a quantity of suck-backed liquid.

Now the process of melting and sealing the forward end of each ampule a will be described.

Figure 34:
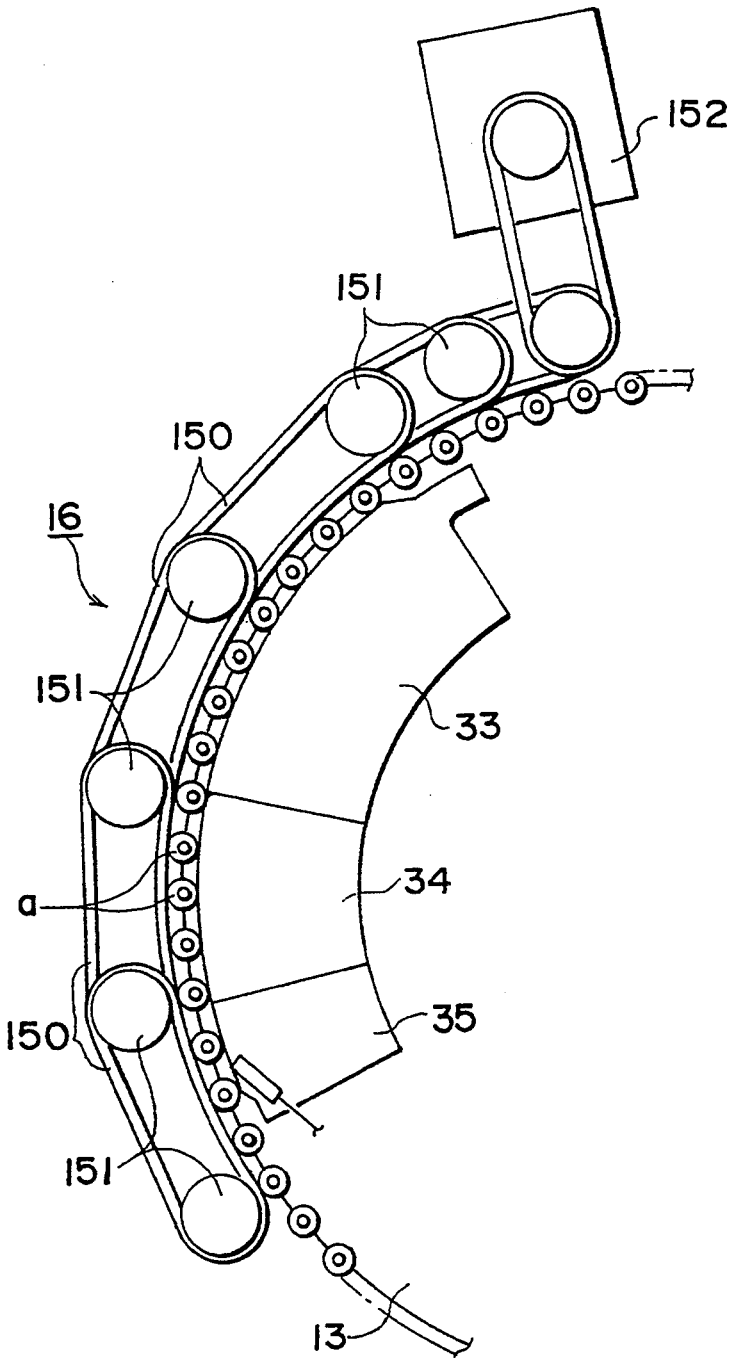
FIG. 34 is a plan view of a burner 16.
Figure 36:
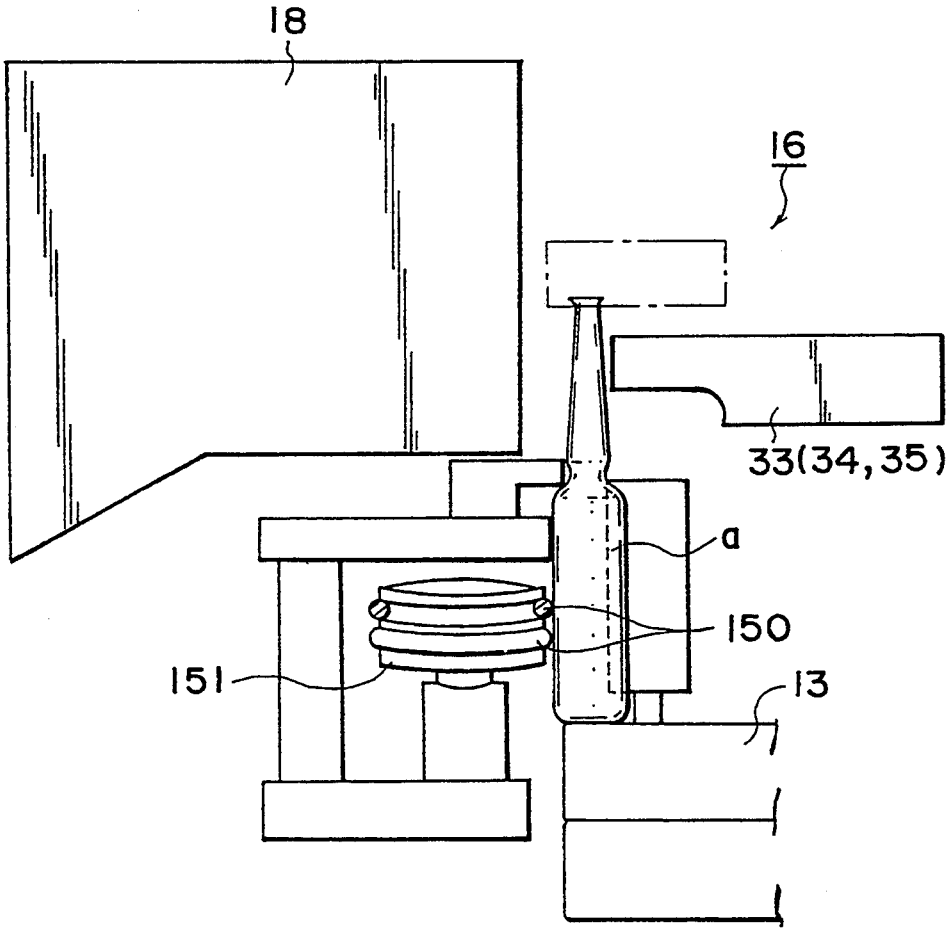
FIG. 36 is a side view of the burner 16 shown by FIG. 34.

FIGS. 34, 35 and 36 are plan, front and side views, respectively, of the burner 16. As shown, the burner 16 comprises three burner sections 33, 34, 35 adapted to throw flame against the upper ends of the respective ampules a being transported by rotation of the turntable 13 and thereby to hear seal these upper ends. There is provided an auxiliary burner 149 (see FIG. 35) adjacent the burner section 35. The exhaust duct 18 extends in parallel to the train of ampules on the side opposite to those burner sections 33, 34, 35.

A belt 150 is frictionally engaged with cylindric bodies of the ampules a traveling in front of the burner sections 33, 34, 35 so as to rotate them. The belt 150 comprises an endless belt draped about a plurality of rollers 151 and is driven by a motor 152 to rotate the ampules a. Alternatively, an arrangement is also possible such that the belt 150 is stationary mounted and movement of the turntable 13 relative to said stationary belt 150 is utilized to rotate the ampules a. The belt 150 is obliquely provided so as to present its height gradually decreasing along a direction In which the turntable 13 rotates and thereby to assure a downwardly directed frictional force always to be exerted on the ampules a being transported as the turntable 13 rotates.

As will be apparent from FIG. 35, a plurality of flame spouts 155, 156 formed in the burner sections 33, 34, respectively, are horizontally arranged while a plurality of flame spouts 157 formed in the burner section 35 are obliquely arranged so as to present their heights gradually increasing along the direction in which the turntable 13 rotates. The auxiliary burner 149 is positioned so as to throw flame against the upper end of the ampule a traveling near by the burner section 35. It should be understood that the respective burner sections 33, 34, 35 may be independent of continuous and it is also possible to achieve desired heat sealing effect without use of said auxiliary burner 149.

The principal operation of the filling/sealing apparatus according to the invent ion as has been described hereinabove will be described more in details.

Referring first to FIG. 1, the ampules a which have been transported by the conveyor 31 along the direction indicated by an arrow and have their upper ends still remaining opened are successively received by the peripheral recesses 12 of the feed star wheel 11, then transported along the guide 26 and successively delivered to the turntable 13 via the intermediate star wheel 21.

When it is desired for any reasons to stop feeding of additional ampules a, the cylinders 55 may be extended to close the peripheral recesses 12 of the feed star wheel 11 with the shutter plates 41, 42 in the manner as has previously been described in reference with FIG. 6, then further rotation of the feed star wheel 11 may be stopped when the recess 12 holding no ampule a reaches the point of tangency between the feed star wheel 11 and the intermediate star wheel 21, as shown by FIG. 8. In this manner, feeding of additional ampules a from the feed star wheel 11 to the intermediate star wheel 21 can be interrupted.

The ampules a having already been delivered to the intermediate star wheel 21 delivered to the turntable 13 where these ampules a are subjected to the subsequent process of filling and sealing. In other words, the apparatus as a whole is never slopped in the course of filling and sealing and therefore no deficient ampule is produced.

If the ampule having no head a' is delivered to the intermediate star wheel 21, the upper sensor 72 will detect the absence of the ampule while the lower sensor 73 will detect the presence of the ampule, so this ampule will be determined to be a deficient ampule a" and will be blown away by air jet emitted from the nozzle 75 as it will be best seen in FIG. 11.

In this manner, only the normal ampules a are successively delivered to the turntable 13.

Figure 37:
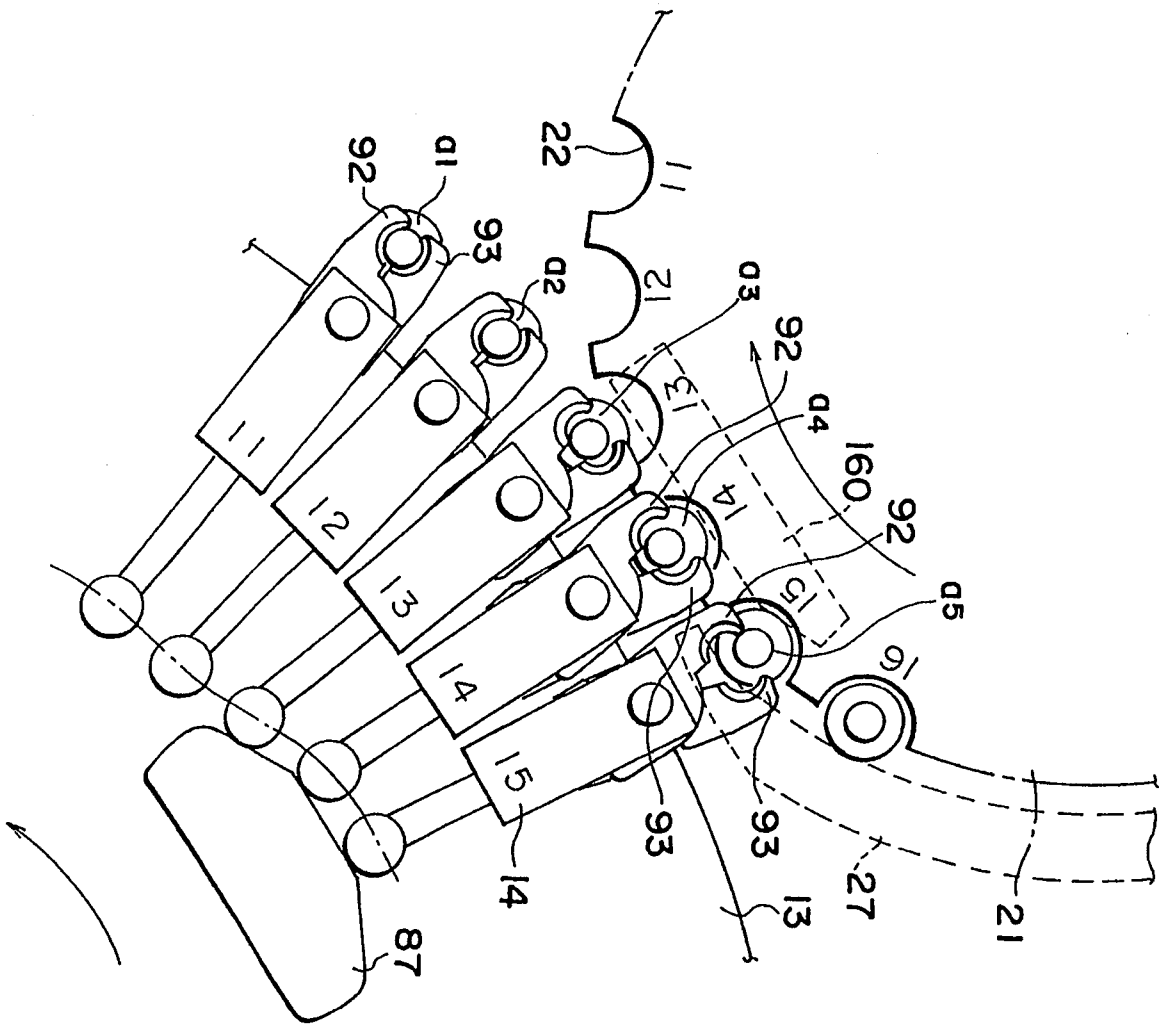
FIG. 37 is a plan view illustrating a manner in which the ampules are fed from the intermediate star wheel to the turntable 13.

FIG. 37 illustrates a manner in which the ampules a are delivered from the intermediate star wheel 21 to the turntable 13.

As has previously been described in reference with FIGS. 13 through 15, the cam 88 serving to open and close the pincers is sufficiently high at the point of tangency defined between the intermediate star wheel 21 and the turntable 13 to urge the follower so as to separate the forward ends of the pinch hands 92, 93 from each other. In this state of the pincers 14, the ampules a which have been transported by the intermediate star wheel 21 now are guided by the guide 160 away from the recessed 22 of the intermediate star wheel 21 and the upper ends of the ampules a successively enter between the pinch hands 92, 93.

As the ampules a travel slightly beyond said point of tangency between the intermediate star wheel 21 and the turntable 13, the cam 88 serving to open and close the pincers becomes low and, as a result, the forward ends of the pinch hands 92, 93 are gradually closed to each other under the biasing force of the springs 100 associated with the respective pincers 14 until the upper ends of the respective ampules a are pinched by the respective pincers 14 (See FIG. 13).

Thus, the ampules a are counterclockwise transported with their upper ends pinched by the respective pincers 14 as the turntable 13 rotates.

These ampules a are then filled by the filling unit 15 with gaseous nitrogen, liquid and gaseous nitrogen in this order. To achieve such operation of filling, the filling needles 127 are driven by the pick-and-place unit 83 into the respective ampules a. As has already been mentioned in reference with FIG. 23, the liquid is obliquely jetted through the spouts 128 against the inner side wail of the respective ampules a so that the liquid strikes against the inner side walls of the respective ampules a and the problem of foaming is effectively avoided.

The suck-back mechanism incorporated in the liquid feed pump 17 significantly contributes to avoid the liquid drip on the forward end of each filling needle 127 as well as the undesirable phenomenon of foaming. Consequently, the ampules can be sealed in a uniform shape without any burn and a quantity of liquid to be introduced in to each ampule a can be precisely controlled.

Moreover, as has been described, the end of the branch portion of the ampules is pinched by pinch hands 92, 93 of the pincer 14 so that the center of the end portion of the ampules is easily determined and stable filling of nitrogen gas or fluid is achieved by inserting filling needle 127 into the end portion of ampules without damaging the branch portion thereof.

As the ampules a thus filled with the liquid and further transported by the turntable 13 approach closely to the first burner section 33 of the burner 16, the height of the cam 88 serving to open and close the pincers 14 increases sufficiently to urge the follower 99 and thereby to separate the forward ends of the pinch hands 92, 93 from each other. The cylindric bodies of the ampules a thus released from the respective pincers 14 are then engaged by the belt 150 and thereby rotated while the ampules a are traveling in front of the respective burner sections 33, 34, 35 adapted for throwing flame uniformly against the upper portions of the ampules a and gradually heating them.

Figure 17:
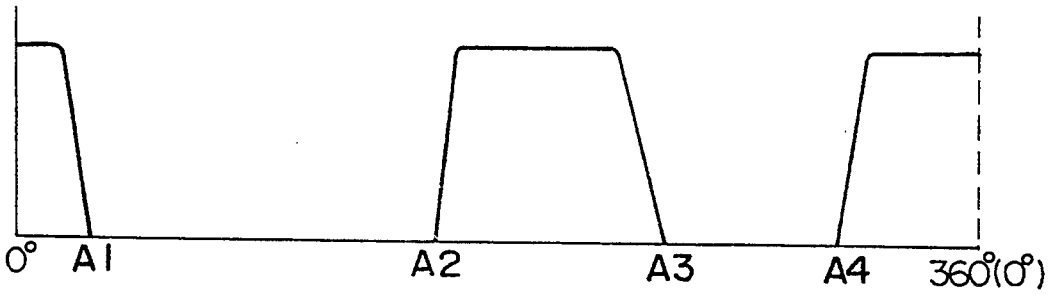
FIG. 17 is a graphic diagram showing operation of the cam 88 serving to open and close the pincers.

As the ampules a have their upper portions molten as they approach closely to the third burner section 35, the height of the cam 88 serving to open and close the pincers 14 gradually decreases again as has already been described in reference with FIGS. 18, 16 and 17. Correspondingly, the forward ends of the pinch hands 92, 93 are gradually closed to each other and pinch the upper ends of the ampules a again therebetween. In this way, the belt 150 tends to rotate the cylindric bodies of the respective ampules a while the pincers 14 pinch the upper ends of these ampules a and thereby a torsion torque is generated in the upper portion of each ampule a which has been heated and is molten. Such torsion torque cooperates with the burner flame to remove the unnecessary branch portion of each ampule a and then to seal the upper end of the ampule a.

The height of the cam 87 serving to move the pincers up- and downward increases as the upper ends of the ampules a are sealed, as has previously been described in reference with FIGS. 16 and 18 and, as a result, the pincers 14 ascend under the biasing force of the spring 109 (See FIG. 12) so as to carry away upward the upper branch portions burned off from the respective ampules a.

The center position of the end of the branch portion of ampules is easily determined by pinching the end of the branch portion by pinch hands 92, 93 of the pincer 14. Therefore, the end of the branch portion of the ampules is vertically pulled up as the cam serving to move the pincers up- and downward vertically moves. In this manner, the upper branch portion of the ampules burned off will be left in a good shape.

Although the upper ends of these ampules a having their upper branch portions thus carried away initially present somewhat pointed shapes, they are gradually rounded with uniform wall thickness as they continue to be heated for awhile by radiated heat from the spouts 157 obliquely arranged so that their heights gradually increase along the direction in which the turntable 13 rotates. It is possible to direct the flame jetted from the auxiliary burner 149 also to the upper ends of the ampules a.

Upon completion of their filling and sealing, the ampules a are transported along the guides 28, 29 as the intermediate star wheels 24, 25 rotate and finally discharged by the screw conveyor 20 into the chute 32, as already described in reference with FIG. 1.

The upper branch portions of the ampules a burned off by the burner 16 and remaining pinched by the pincers 14, on the other hand, are transported as the turntable 13 continues to rotate to a position corresponding to discharging chute 19, at which the height of the cam 88 serving to open and close the pincers increases again and the cam 88 urges the follower 99 to separate the forward ends of the pinch hands 92, 93 from each other. Thus, the upper branch portions of the ampules a are discharged through the discharging chute 19.

While the filling/sealing apparatus of invention has been described with respect to the embodiment used with the ampules, the invention is not limited to such specific application and covers also, for example, a filling/sealing apparatus used with vials.

Now an arrangement for monitoring the result of process will be discussed, in which the number of ampules to be transported at once by the star wheels as well as the turntable, respectively, are set to integral times as many as the filling needles, each group comprising ampules as many as the filling needles are numbered and the ampules are transported group by group so that the ampules may be samples and checked in comparison based on the individual numbers.

Figure 38:
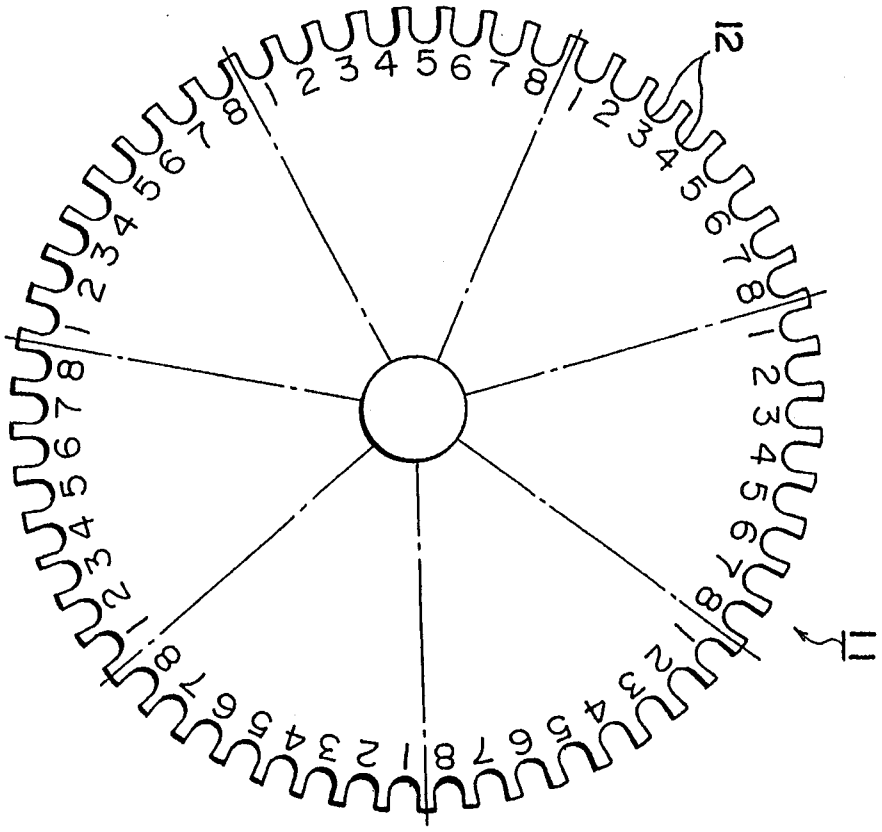
FIG. 38 is a plan view showing the feed star wheel 11 carrying numbers.

FIG. 38 is a plan view of the feed star wheel 11 shown by FIG. 1. The feed star wheel 11 is provided along its peripheral surface with $8\times7=56$ recesses 12 which are divided into seven groups each comprises the recesses 12 as many as the filling needles, i.e., eight recesses 12 and the recesses 12 of each group are numbered from 1 to 8 in the clockwise order.

Figure 39:
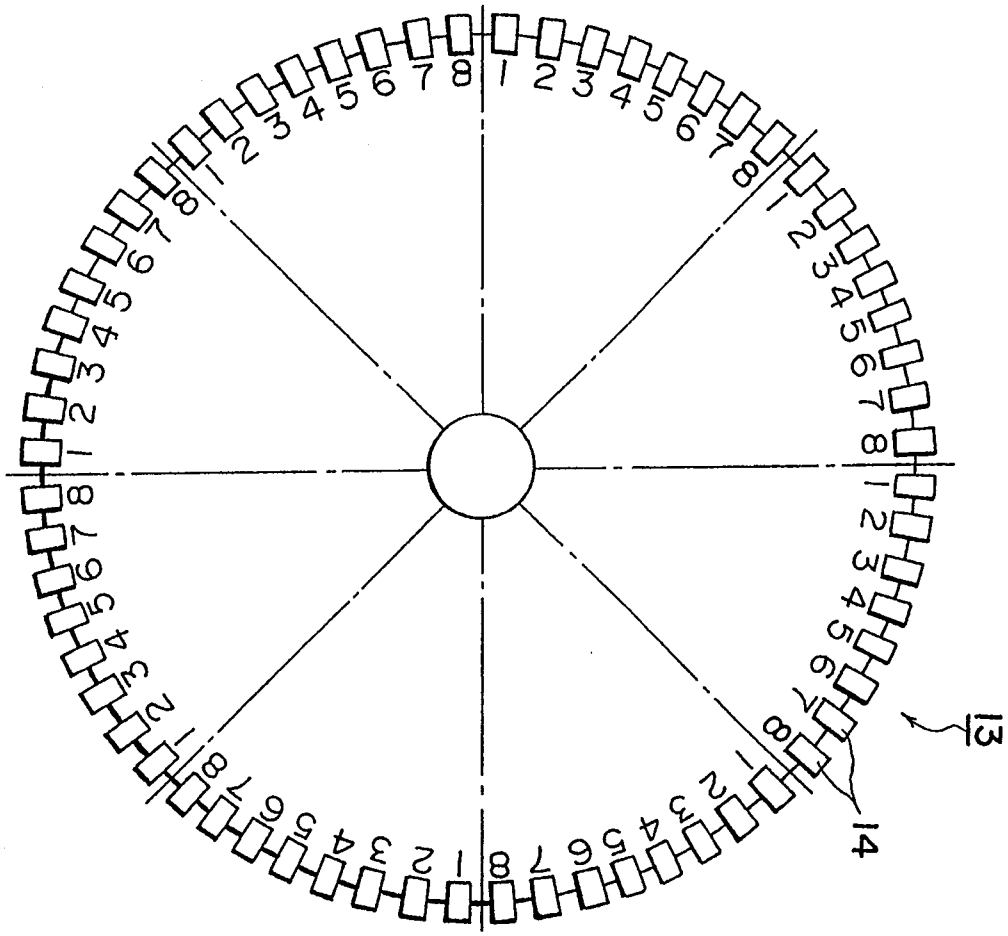
FIG. 39 is a plan view showing the turntable with the pincers 14 carrying numbers.

FIG. 39 is a plan view of the turntable 13 shown by FIG. 1. The turntable 13 is peripherally provided with $8\times8=64$ pincers 14 (See FIGS. 13 through 15). These pincers 14 are divided into eight groups each comprising eight pincers 14. The pincers 14 of each group carry thereon numbers from 1 to 8 in the clockwise order.

Figure 40:
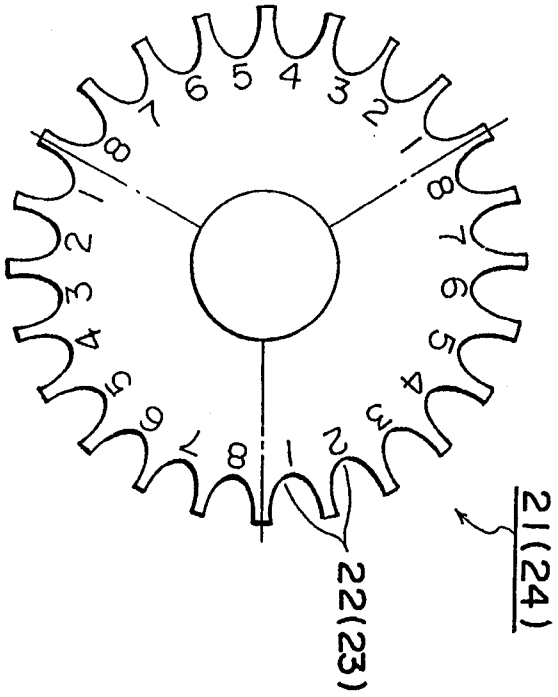
FIG. 40 is a plan view showing the intermediate star wheels 21, 22 both carrying numbers.

FIG. 40 in a plan view showing the intermediate star wheel 21, 24 of an identical construction. The intermediate star wheel 21 (24) is peripherally provided with $8\times3=24$ recessed 22 (23). These recesses 22 (23) are divided into three groups each comprising eight recesses. The recesses 22 (23) of each group are numbered from 1 to 8 in the counterclockwise order.

Figure 41:
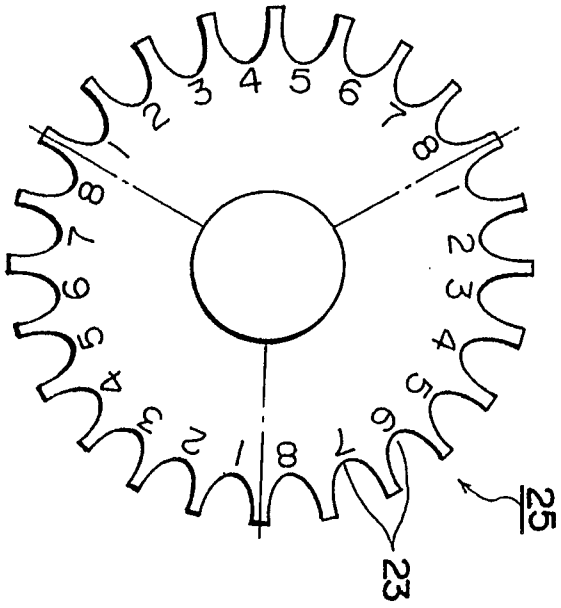
FIG. 41 is a plan view showing the intermediate star wheel 25 carrying numbers.

FIG. 41 is a plan view of the intermediate star wheel 25. The intermediate star wheel 25 is peripherally provided with $8\times3=24$ recesses 23 which are divided into three groups each comprising eight recesses 23. The recesses 23 of each group are numbered from 1 to 8 in the clockwise order.

FIG. 20 is a perspective view of the liquid filling unit 120 and the gaseous nitrogen filling unit 121. As shown, the eight filling needles 127 mounted on the underside of each unit 120 (121) are also numbered from 1 to 8.

With such arrangement, the ampules a are continuously transported as the turntable 18 rotates while the filling needles 127 are driven by the pick-and-place unit to be simultaneously rotated and up- and downward moved together with the ampules a being transported by the turntable 13, thus eight ampules a are filled with the liquid at once.

Now the manner in which the filling/sealing apparatus of the invention operates will be described more in details particularly in connection with transport of ampules group by group. As shown by FIG. 1, the ampules a which have been transported by the conveyor 81 along the direction as indicated by the arrow and have their upper ends still remaining opened are successively received by the recesses 12 (Nos. 1 through 8) of the feed star wheel 11 to be further transported along the guide 26 and then successively delivered to the intermediate star wheel 21 (see FIG. 38). FIG. 9 shows the manner in which the ampules a which have been transported by the feed star wheel 11 are delivered to the intermediate star wheel 21. As shown, the ampules a which have been transported by the respective recesses 12 of the feed star wheel 11 are then guided by the forward end of the guide 26 so as to be successively received by the recesses 22 wherein the ampule a1 which has been transported by the first recess 12 of the feed star wheel 11 is received by the first recess 22 of the intermediate star wheel 21 and the ampule a2 which has been transported by the second recess 12 of the feed star wheel 11 is received by the second recess 22 of the intermediate star wheel 21 and so on. Thus the ampules a1 through a8 which have been transported by the first through eighth recesses 12 of the feed star wheel 11 are received by the correspondingly numbered recesses 22 of the intermediate star wheel 21 (See FIG. 40).

The ampules a delivered to the intermediate star wheel 21 in this manner are then delivered to the turntable 13.

FIG. 37 shows the manner in which the ampules a are delivered from the intermediate star wheel 21 to the turntable 13. As shown, the pinch hands 92, 93 of the respective pincers 14 have their opposed forward ends separated from each other at the point of tangency between the intermediate star wheel 21 and the turntable 13 and, after the upper ends of respective ampules a have entered between these pinch hands 92, 93, the forward ends of these pinch hands 92, 93 gradually close to each other until they firmly pinch the upper ends of respective ampules a therebetween. Here also the ampules a1 through a8 which have been transported by the first through eighth recesses 22 of the intermediate star wheel 21, respectively, are pinched and transported by the first through eighth pincers 14 of the turntable 13, respectively.

Also in the liquid filling unit 120 and the gaseous nitrogen filling unit 121 shown by FIG. 20, eight filling needles 127 are simultaneously driven by the pick-and-place unit downward into eight ampules a, as has previously been described, wherein the filling needles 127 numbered 1 through 8 enter the ampules a1 through a8 pinched by the correspondingly numbered pincers 14. In this way, with the filling needles 127 driven into the respective ampules a1 through a8, the liquid feed pump 17 may be actuated to fill the eight ampules a with the liquid at once.

Subsequently, the upper ends of respective ampules a are heat sealed in the manner as previously described.

The ampules a thus sealed are successively delivered to the intermediate star wheels 24, 25, then guided along the guides 28, 29 and finally discharged by the screw conveyor 30 into the chute 32. Here again, the ampules a1 through a8 which have been pinched and transported by the pinches 14 numbered 1 through 8 of the turntable 13 are received by the correspondingly numbered recesses 23 (See FIG. 40) of the intermediate star wheel 24, then received by the correspondingly numbered recesses 23 (See FIG. 41) of the intermediate star wheel 25 and delivered to the screw conveyor 20.

The number of the ampules that can be held at once by the star wheels as well as the turntable is set to integral times as many as the filling Needles, the ampules are divided into groups each comprising the number of the filling needles, and the individual ampules are numbered for each group so that the ampules may be transported group by group and sampled according to the numbers of individual ampules in this group to check and therefore to control a quantity of oxygen contained in a space defined above the liquid in each ampule as well as a quantity of the liquid having been introduced into each ampule for every filling needle. Additionally, in view of a fact that a liquid drip from the filling needle, if any, might adversely affect the sealing effect on the upper end of each ampule, the sealed upper ends of the ampules can be compared one to another within each group to check said liquid drip from the filling needle.

While the invention has been described by way of example with respect to the filling/sealing apparatus for use with ampule, it should be understood that the invention covers such apparatus for use with container other than ampule, for example, vial, in addition, the number of ampules constituting each group is not limited to eight but may be more or less than eight.

While the invention has been particularly shown and described with reference to preferred embodiment thereof, it will be understood by those skilled in the art that the foregoing and other changed in form and details can be made therein without departing from the spirit and scope of the invention.

What is claimed is:

1. A filling/sealing apparatus for filling empty ampules having an opened upper end with a liquid and sealing the liquid-filled ampules at the upper end, comprising:

(A) a turntable rotatable about an axis thereof in a predetermined direction for transporting a plurality of ampules around a peripheral portion thereof;

(B) a feed star wheel for feeding empty ampules to the turntable;

(C) a liquid filling unit positioned along the peripheral portion of the turntable and having a plurality of filling needles, each one of which is substantially simultaneously receivable in an opened upper end of a respective ampule of a plurality of ampules such that each ampule of the plurality of ampules substantially simultaneously receives a needle and is substantially simultaneously filled with the liquid;

(D) a sealing unit positioned along the peripheral portion of the turntable at a distance along the predetermined direction greater than that of the liquid filling unit, and having a plurality of flame spouts positioned to continuously and substantially simultaneously heat and seal upper ends of a plurality of liquid-filled ampules as the ampules are moved along the plurality of flame spouts; and (E) pincer means adapted to pinch sides of the upper ends of the ampules during filling and sealing, such that the ampules are held in a stable, upright, vertical position during filling thereof and an uppermost portion of each sealed upper end is removed therefrom.

2. Filling/sealing apparatus according to claim 1, further comprising shutters for preventing ampules from being received by recesses formed in a peripheral surface of the feed star wheel.

3. Filling/sealing apparatus according to claim 1, further comprising an intermediate star wheel positioned between the feed star wheel and the turntable, sensors for determining whether the ampules being transported have upper ends or not, and means for removing ampules having no upper end.

4. Filling/sealing apparatus according to claim 3, wherein the ampules having no upper end are removed by a nozzle adapted to jet an air stream.

5. Filling/sealing apparatus according to claim 1, wherein each filling needle is provided on its forward end with a spout adapted for laterally jetting the liquid as a stream.

6. Filling/sealing apparatus according to claim 5, wherein each filling needle has two or four spouts adapted for laterally jetting the liquid as a stream.

7. Filling/sealing apparatus according to claim 1, further comprising a liquid feed pump for pumping the liquid into the respective filling needles and the feed pump is provided with a suck-back means adapted to direct the liquid back into the respective filling needles immediately after filling.

8. Filling/sealing apparatus according to claim 1, wherein the sealing unit includes means for continuing to heat a sealed portion of an ampule for a period of time after the ampule has been sealed.

9. Filling/sealing apparatus according to claim 1, wherein the uppermost portion of the sealed upper end is pinchable by pinch hands of the pincer means.

10. In a filling/sealing apparatus according to claim 1, wherein the number of ampules that can be held by the turntable and the feed star wheel is an integral number times as many ampules that can be simultaneously filled by the filling needles and wherein the ampules are dividable into groups having the same number of ampules as that which can be simultaneously filled by said filling needles so that results of the filling can be monitored for every such group.

* * * * *